US008421684B2

(12) United States Patent
Livneh et al.

(10) Patent No.: US 8,421,684 B2
(45) Date of Patent: Apr. 16, 2013

(54) METHODS AND APPARATUS FOR BEAM STEERING USING STEERABLE BEAM ANTENNAS WITH SWITCHED PARASITIC ELEMENTS

(75) Inventors: Noam Livneh, Haifa (IL); Raphael Katsner, Hod Hasharon (IL); Ernest Ozaki, San Diego, CA (US); Vered Bar Bracha, Haifa (IL); Mohammad A. Tassoudji, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 648 days.

(21) Appl. No.: 12/571,667

(22) Filed: Oct. 1, 2009

(65) Prior Publication Data

US 2011/0080325 A1 Apr. 7, 2011

(51) Int. Cl.
*H01Q 1/24* (2006.01)

(52) U.S. Cl.
USPC ..... 343/702

(58) Field of Classification Search ..... 343/702, 343/833, 834, 754, 749–751, 818–819; 342/374
See application file for complete search history.

(56) References Cited

U.S. PATENT DOCUMENTS

| | | | | |
|---|---|---|---|---|
| 3,560,978 | A | 2/1971 | Himmel | |
| 6,188,373 | B1 | 2/2001 | Martek | |
| 6,313,807 | B1 | 11/2001 | Kolak | |
| 6,956,533 | B2 * | 10/2005 | Lindenmeier | 343/749 |
| 7,106,270 | B2 * | 9/2006 | Iigusa et al. | 343/833 |
| 7,176,844 | B2 * | 2/2007 | Chiang et al. | 343/815 |
| 7,630,738 | B2 * | 12/2009 | Hirano et al. | 455/562.1 |
| 7,956,815 | B2 * | 6/2011 | Ohira et al. | 343/730 |
| 8,059,031 | B2 * | 11/2011 | Lee | 342/432 |
| 2002/0158798 | A1 | 10/2002 | Chiang et al. | |
| 2003/0193446 | A1 | 10/2003 | Chen | |

FOREIGN PATENT DOCUMENTS

EP 1113523 A1 7/2001

OTHER PUBLICATIONS

R.F. Harrington, "Reactively Controlled Directive Arrays," IEEE Transactions on Antennas and Propagation, May 1978, vol. 26, No. 3, pp. 390-395.

David V. Thiel, "Switched Parasitic Antennas and Controlled Reactance Parasitic Antennas: A Systems Comparison", Jun. 2004, Proc. 2004 International IEEE AP-S Symposium, pp. 3211-3214.

Thomas Svantesson, "High-Resolution Direction Finding Using a Switched Parasitic Antenna".

Blagovest Shishkov et al., "Reactively Controlled Adaptive Arrays—A Key Technology for Achieving the Wireless Ad-Hoc Community Network".

International Search Report and Written Opinion—PCT/US2010/051232, International Search Authority—European Patent Office—Mar. 22, 2011.

* cited by examiner

*Primary Examiner* — Huedung Mancuso
(74) *Attorney, Agent, or Firm* — Kevin T. Cheatham

(57) ABSTRACT

An antenna is described. The antenna includes a planar circular structure. The antenna also includes a radiating element located at the center of the planar circular structure. The antenna further includes one or more parasitic elements located on a contour around the radiating element. The parasitic elements are aligned in parallel direction with the radiating element. The parasitic elements protrude from the planar circular structure. The antenna includes switches separating each of the one or more parasitic elements from ground. A switch in a first position creates a short between a parasitic element and ground. A switch in a second position creates an open circuit between the parasitic element and ground.

24 Claims, 15 Drawing Sheets

METHODS AND APPARATUS FOR BEAM STEERING USING STEERABLE BEAM ANTENNAS WITH SWITCHED PARASITIC ELEMENTS

TECHNICAL FIELD

The present disclosure relates generally to communication systems. More specifically, the present disclosure relates to methods and apparatus for steerable beam antennas with switched parasitic elements.

BACKGROUND

Transmitting a high data rate over the 60 GHz frequency band requires considerable antenna gain as well as flexibility in the orientation of the end-point devices. To this end, two dimensional arrays with a multiplicity of phase shifters have traditionally been used. The main drawbacks associated with these solutions, however, are high complexity and cost due to the potentially large number of phase shifters incorporated into the architecture of two dimensional arrays.

In addition, because the phase shifters are placed in the line of the signal, high radio frequency (RF) losses may occur. Such losses may decrease the data rate and transmission distance of wireless communication devices used. Furthermore, two dimensional arrays using a multiplicity of phase shifters may have limited angular coverage in both azimuth and elevation planes.

SUMMARY

An antenna is described. The antenna includes a planar circular structure. The antenna also includes a radiating element located at the center of the planar circular structure. The antenna also includes one or more parasitic elements located on a contour around the radiating element. The one or more parasitic elements are aligned in a parallel direction with the radiating element. The one or more parasitic elements protrude from the planar circular structure. Each of the parasitic elements is loaded by a reactive load as part of a passive circuit. The antenna also includes multiple throw switches. The multiple throw switches may separate each of the parasitic elements from ground and/or one or more reactive loads. In a first position of a switch, a short between a parasitic element and ground may be created. In a second position of a switch, an open circuit between the parasitic element and ground may be created. A switch may also create a closed circuit between a parasitic element, a reactive load, and ground. For example, a switch may create a closed circuit between a parasitic element and a lumped or distributed reactive load. The switch position may connect the parasitic element to one or more reactive loads between the parasitic element and ground. If more than one reactive load is included, each reactive load may have a different value.

Any of the one or more parasitic elements may act as a reflector when the switch between the parasitic element and ground is closed and the parasitic element is shorted to ground. When a parasitic element acts as a reflector, the parasitic element may reflect electromagnetic energy with a phase of 180 degrees. Any of the one or more parasitic elements may act as a director when the switch between the parasitic element and ground is open. When a parasitic element acts as a director, the parasitic element may reflect electromagnetic energy with a phase of 0 degrees. Any of the one or more parasitic elements may reflect electromagnetic energy in phases other than 180 or 0 degrees when a switch connects a reactive load between the parasitic element and ground. With one or more reactive loads, a greater flexibility in controlling the radiation patter of the antenna may be achieved.

In one configuration the antenna may be a dipole antenna. The planar circular structure may be a non-conductive material. The radiating element and each of the parasitic elements may protrude perpendicularly from the planar circular structure in both directions.

In another configuration the antenna may be a monopole antenna. The planar circular structure may be a conductive material tied to ground. The radiating element and each of the parasitic elements may protrude perpendicularly from the planar circular structure in one direction. In this configuration, the switches at the parasitic elements may be between the two monopoles of the dipole.

Active beam steering control of the antenna over the 360 degree azimuth may be achieved by altering the configuration of open switches, closed switches, and switches connecting reactive loads between the parasitic elements and ground. Active beam steering control may produce a discrete number of switchable beams.

The antenna may also include one or more similar antennas stacked perpendicular to the antenna. The similar antennas may have the same number of parasitic elements as the antenna. Each of the similar antennas may have the same configuration of open switches and closed switches between parasitic elements and ground as the antenna. The antenna may be capable of transmitting electromagnetic signals and receiving electromagnetic signals. The antenna may be fed at a single port of the radiating element. The antenna may have no power dividing network. The stacked antennas may be fed as elements of a phased array with an adjustable phase difference between the elements enabling control of an elevation angle of a main radiation beam.

A wireless communication device configured for beam steering is also described. The wireless communication device includes two or more one dimensional switched beam antennas stacked vertically, a processor, and memory in electronic communication with the processor. Instructions stored in the memory may be executable by the processor to load one or more parasitic elements on each one dimensional switched beam antenna with reactive loads. One or more of the parasitic elements may be switched to act as reflectors. Any of the one or more parasitic elements may act as a reflector when a switch between a parasitic element and ground is closed and the parasitic element is shorted to ground. The parasitic elements not acting as reflectors may be switched to act as directors. Any of the parasitic elements may act as a director when the switch between the parasitic element and ground is open and no reactive load is connected to the parasitic element.

Transmission signal streams may be fed to the radiating elements on each one dimensional switched beam antenna to form a beam. The configuration of parasitic elements acting as reflectors and directors may be adjusted to steer the direction of each one dimensional switched beam antenna over the 360 degree azimuth. Phase differences between each transmission signal stream fed to the radiating elements on the two or more one dimensional switched beam antennas may be adjusted to steer the direction of the vertically stacked two or more one dimensional switched beam antennas in elevation.

Each one dimensional switched beam antenna may include a planar circular structure. Each one dimensional switched beam antenna may also include a radiating element located at the center of the planar circular structure. Each one dimensional switched beam antenna may further include one or more parasitic elements located on a contour around the radiating element that are aligned in parallel direction with the radiating element. The parasitic elements may protrude from the planar circular structure, and each of the parasitic elements may be loaded by a reactive load as part of a passive circuit. Each one dimensional switched beam antenna may also include switches separating each of the one or more parasitic elements from ground. A closed switch may create a short between a parasitic element and ground, and an open switch may create an open circuit between the parasitic element and ground. A switch may also create a closed circuit between a parasitic element and the reactive load. For example, a switch may create a closed circuit between a parasitic element and a lumped or distributed reactive load.

Each of the vertically stacked one dimensional switched beam antennas may use the same configuration of parasitic elements acting as reflectors and parasitic elements acting as directors. Signal streams may be fed to each radiating element of each one dimensional switched beam antenna to form a beam. Phase differences between the signal streams may steer the elevation of the beam and control a radiation pattern of the beam in elevation.

A method for beam steering is described. One or more parasitic elements are loaded on a one dimensional switched beam antenna with reactive loads. One or more of the parasitic elements are switched to act as reflectors. Any of the one or more parasitic elements acts as a reflector when a switch between the parasitic element and ground is closed and the parasitic element is shorted to ground. The parasitic elements not acting as reflectors are switched to act as directors. Any of the parasitic elements acts as a director when the switch between the parasitic element and ground is open. The parasitic elements acting as reflectors and directors are adjusted to steer the direction of each one dimensional switched beam antenna over the 360 degree azimuth.

Two or more one dimensional switched beam antennas may be vertically stacked. Transmission signal streams may be fed to the radiating elements on the vertically stacked two or more one dimensional switched beam antennas to form a beam. Phase differences between the transmission signal streams may steer the elevation of the beam and control the beam pattern.

Transmission signal streams may be fed to the radiating elements on the vertically stacked two or more one dimensional switched beam antennas. Phase differences between the transmission signal streams fed to the radiating elements on the vertically stacked two or more one dimensional switched beam antennas may be adjusted to steer the direction of the vertically stacked two or more one dimensional switched beam antennas in elevation. Each of the vertically stacked one dimensional switched beam antennas may use the same configuration of parasitic elements acting as reflectors and parasitic elements acting as directors. Signals of the two dimensional antenna may be digitally combined.

A wireless communication device configured for beam steering is also described. The wireless communication device includes means for loading one or more parasitic elements on a one dimensional switched beam antenna with reactive loads. The wireless communication device also includes means for switching one or more of the parasitic elements to act as reflectors. Any of the one or more parasitic elements acts as a reflector when a switch between the parasitic element and ground is closed and the parasitic element is shorted to ground. The wireless communication device further includes means for switching the parasitic elements not acting as reflectors to act as directors. Any of the parasitic elements acts as a director when the switch between the parasitic element and ground is open. A switch may also create a closed circuit between a parasitic element and the reactive load. For example, a switch may create a closed circuit between a parasitic element and a lumped or distributed reactive load.

The wireless communication device also includes means for vertically stacking two or more one dimensional beam antennas to form a vertical phased array. The wireless communication device further includes means for feeding transmission signal streams to the radiating elements on the vertically stacked two or more one dimensional switched beam antennas. The wireless communication device also includes means for adjusting the configuration of parasitic elements acting as reflectors and directors to steer the direction of each one dimensional switched beam antenna over the 360 degree azimuth. The wireless communication device further includes means for adjusting phase differences between the transmission signal streams fed to the two or more one dimensional switched beam antennas that form the vertical phased array to steer the direction of the two or more one dimensional switched beam antennas in elevation.

The wireless communication device may also include means for combining and processing signals received from each of the vertically stacked two or more one dimensional switched beam antennas. The wireless communication device may further include means for splitting and processing signals transmitted by each of the vertically stacked two or more one dimensional switched beam antennas.

A computer-readable medium for beam steering is described. The computer-readable medium includes instructions thereon. The instructions are for loading one or more parasitic elements on a one dimensional switched beam antenna with reactive loads and for switching one or more of the parasitic elements to act as reflectors. Any of the one or more parasitic elements acts as a reflector when a switch between the parasitic element and ground is closed and the parasitic element is shorted to ground. The instructions are further for switching the parasitic elements not acting as reflectors to act as directors. Any of the parasitic elements acts as a director when the switch between the parasitic element and ground is open.

The instructions are also for feeding transmission signal streams to radiating elements on two or more vertically stacked one dimensional switched beam antennas. The instructions are for adjusting the configuration of parasitic elements acting as reflectors and directors to steer the direction of each vertically stacked one dimensional switched beam antenna over the 360 degree azimuth. The instructions also are for adjusting phase differences between the transmission signal streams fed to the radiating elements on the two or more vertically stacked one dimensional switched beam antennas to steer the direction of the vertically stacked two or more one dimensional switched beam antennas in elevation.

A wireless communication device configured for beam steering is described. The wireless communication device includes two or more one dimensional switched beam antennas stacked vertically, a processor, and memory in electronic communication with the processor. Instructions stored in the memory are executable by the processor to load one or more parasitic elements on each one dimensional switched beam antenna with reactive loads. One or more of the parasitic elements are switched to act as reflectors. Any of the one or more parasitic elements acts as a reflector when a switch between a parasitic element and ground is closed and the parasitic element is shorted to ground.

The parasitic elements not acting as reflectors are switched to act as directors. Any of the parasitic elements acts as a director when the switch between the parasitic element and ground is open. Transmission signal streams are received from the radiating elements on each one dimensional switched beam antenna. The configuration of parasitic elements acting as reflectors and directors is adjusted to steer the direction of each one dimensional switched beam antenna over the 360 degree azimuth. Phase differences between each transmission signal stream received by the radiating elements on the two or more one dimensional switched beam antennas are adjusted to steer the direction of the vertically stacked two or more one dimensional switched beam antennas in elevation.

Each one dimensional switched beam antenna may include a planar circular structure, a radiating element located at the center of the planar circular structure, and one or more parasitic elements located on a contour around the radiating element. The parasitic elements may be aligned in parallel direction with the radiating element. The parasitic elements may protrude from the planar circular structure. Each of the parasitic elements may be loaded by a reactive load as part of a passive circuit. Each one dimensional switched beam antenna may also include switches separating each of the one or more parasitic elements from ground. A closed switch may create a short between a parasitic element and ground and an open switch may create either an open circuit between the parasitic element and ground or allows the reactive load to be switched in. Each of the vertically stacked one dimensional switched beam antennas may use the same configuration of parasitic elements acting as reflectors and parasitic elements acting as directors.

A wireless communication device configured for beam steering is also described. The wireless communication device includes means for loading one or more parasitic elements on each one dimensional switched beam antenna with reactive loads. The wireless communication device also includes means for switching one or more of the parasitic elements to act as reflectors. Any of the one or more parasitic elements acts as a reflector when a switch between a parasitic element and ground is closed and the parasitic element is shorted to ground. The wireless communication device further includes means for switching the parasitic elements not acting as reflectors to act as directors. Any of the parasitic elements acts as a director when the switch between the parasitic element and ground is open and no reactive load is connected to the parasitic element. The wireless communication device also includes means for receiving transmission signal streams from the radiating elements on each one dimensional switched beam antenna. The wireless communication device further includes means for adjusting the configuration of parasitic elements acting as reflectors and directors to steer the direction of each one dimensional switched beam antenna over the 360 degree azimuth. The wireless communication device also includes means for adjusting phase differences between each transmission signal stream received by the radiating elements on the two or more one dimensional switched beam antennas to steer the direction of the vertically stacked two or more one dimensional switched beam antennas in elevation.

The wireless communication device may include means for combining and processing signals received from each of the vertically stacked two or more one dimensional switched beam antennas.

A wireless communication device configured for beam steering is described. The wireless communication device includes computer-executable instructions for loading one or more parasitic elements on each one dimensional switched beam antenna with reactive loads. The wireless communication device also includes computer-executable instructions for switching one or more of the parasitic elements to act as reflectors. Any of the one or more parasitic elements acts as a reflector when a switch between a parasitic element and ground is closed and the parasitic element is shorted to ground. The wireless communication device further includes computer-executable instructions for switching the parasitic elements not acting as reflectors to act as directors. Any of the parasitic elements acts as a director when the switch between the parasitic element and ground is open. The wireless communication device also includes computer-executable instructions for receiving transmission signal streams from the radiating elements on each one dimensional switched beam antenna. The wireless communication device further includes computer-executable instructions for adjusting the configuration of parasitic elements acting as reflectors and directors to steer the direction of each one dimensional switched beam antenna over the 360 degree azimuth. The wireless communication further device includes computer-executable instructions for adjusting phase differences between each transmission signal stream received by the radiating elements on the two or more one dimensional switched beam antennas to steer the direction of the vertically stacked two or more one dimensional switched beam antennas in elevation.

DETAILED DESCRIPTION

Figure 1:
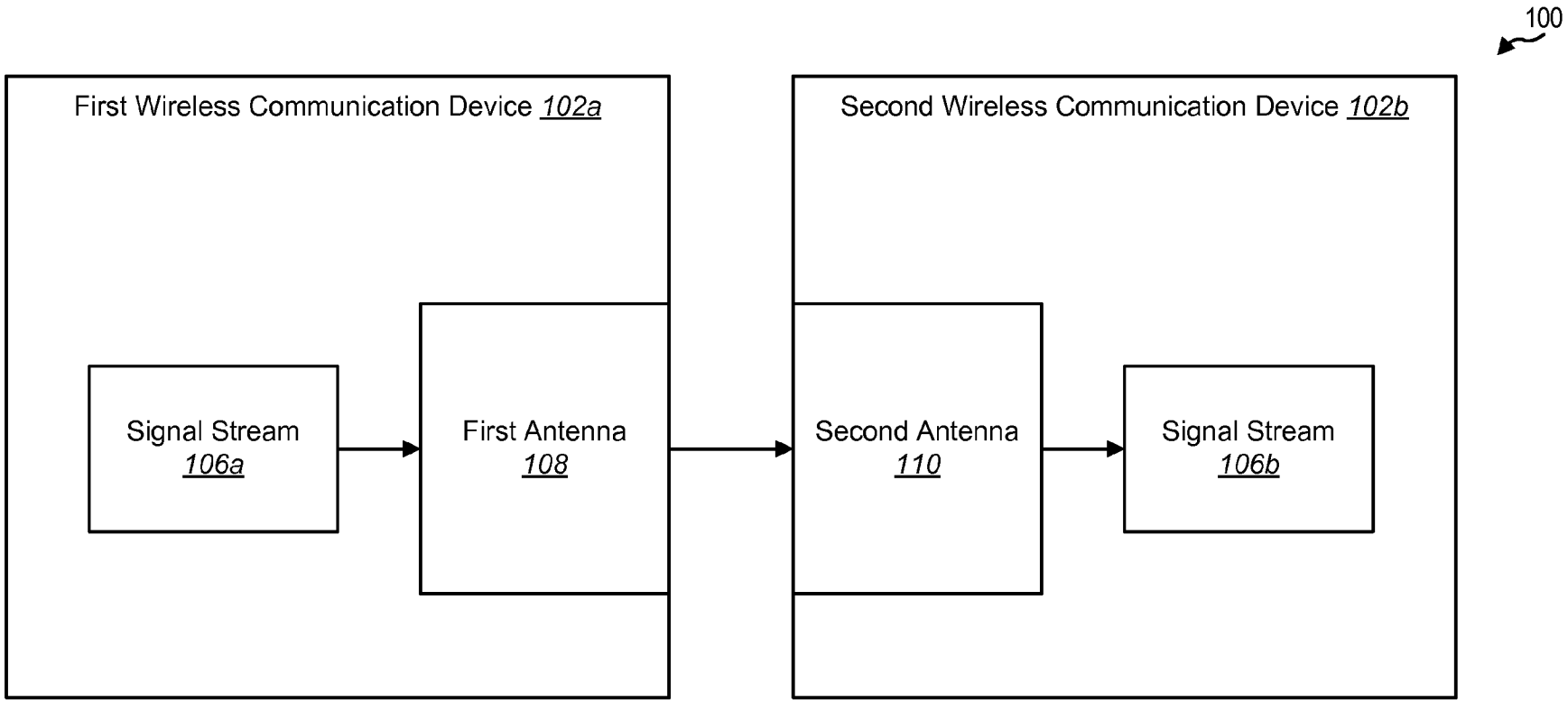
FIG. 1 shows a wireless communication system with a first wireless communication device and a second wireless communication device.

FIG. 1 shows a wireless communication system 100 with a first wireless communication device 102*a* and a second wireless communication device 102*b*. A wireless communication device 102 may be configured to transmit wireless signals, receive wireless signals, or both. For example, the first wireless communication device 102*a* may transmit data as part of a signal stream 106*a* to the second wireless communication device 102*b*. The first wireless communication device 102*a* may transmit data using a first antenna 108.

An antenna may be configured for both transmitting signals and receiving signals. For example, the first wireless communication device 102*a* may use the first antenna 108 for both transmitting and receiving signals. The second wireless communication device 102*b* may receive signals transmitted from the first wireless communication device 102*a* using a second antenna 110. The second wireless communication device 102*b* may thus receive the signal stream 106*b* from the first wireless communication device 102*a*.

Figure 2:
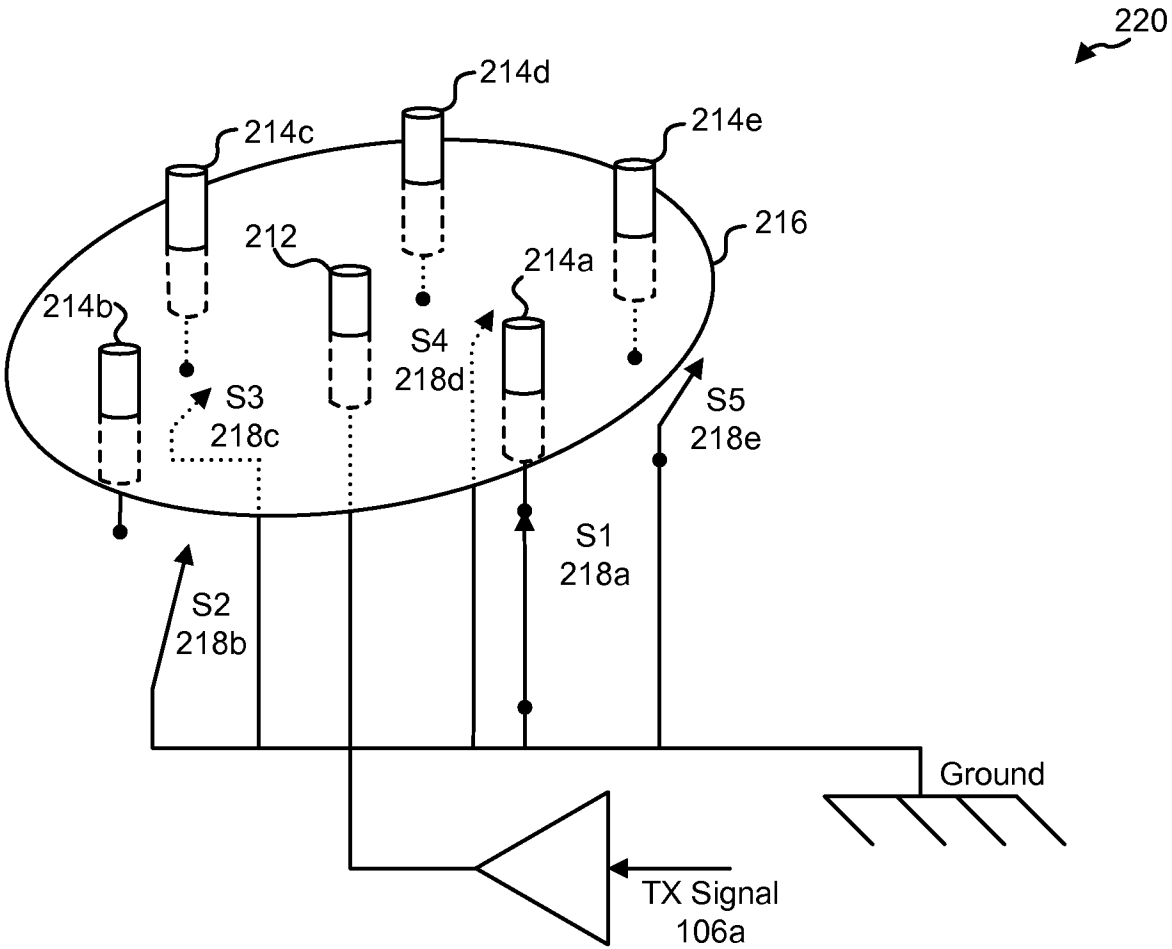
FIG. 2 illustrates a one dimensional switched beam antenna for use in the present methods and apparatus.

FIG. 2 illustrates a one dimensional switched beam antenna 220 for use in the present apparatus and methods. The one dimensional switched beam antenna 220 may be a stackable unit, such that multiple one dimensional switched beam antennas 220 may each be used as an element in a vertical phased array. A vertical phased array is discussed in more detail in relation to FIG. 3. The one dimensional switched beam antenna 220 may include a radiating element 212. The radiating element 212 may be capable of radiating and receiving electromagnetic waves. For example, the radiating element 212 may be a piece of foil, a conductive rod, or a coil. The radiating element 212 may be located at the center of a planar circular structure 216. The radiating element 212 may be either a monopole or a dipole.

If the radiating element 212 is of the monopole type, the planar circular structure 216 may be a conductive ground plane. For example, the conductive planar circular structure 216 may be made out of copper or aluminum. If the radiating element 212 is of the monopole type, the radiating element 212 may protrude perpendicularly from the planar circular structure 216 a distance of one quarter of the wavelength radiated from the radiating element 212. Alternatively, the radiating element 212 may protrude other distances out of the planar circular structure 216. For example, if the radiating element 212 were designed to radiate a signal in the 60 GHz frequency band, the wavelength of the signal may be approximately 5 mm and the radiating element 212 may protrude from the planar circular structure 216 a distance of 1.25 mm. If the radiating element 212 is of the dipole type, the planar circular structure 216 may be a conductive or non-conductive plane. For example, the non-conductive planar circular 216 structure may be formed out of silicon. If the radiating element 212 is of the dipole type, the radiating element 212 may protrude perpendicularly out of each side of the planar circular structure 216 the same distance but the planar structure in this case is not made of conductive material. Alternatively, if the radiating element 212 is of the dipole type, the radiating element 212 may be present at an arbitrary distance from the planar circular structure 216 on one or both sides.

The one dimensional switched beam antenna 220 may also include N (one or more) parasitic elements 214. The parasitic elements 214 may be of the same size and structure as the radiating element 212. Alternatively, the parasitic elements 214 may be of different size than the radiating element 212. For example, if the radiating element 212 is of the monopole type, the parasitic elements 214 may also be of the monopole type. Likewise, if the radiating element 212 is of the dipole type, the parasitic elements 214 may also be of the dipole type. The parasitic elements 214 may be placed on a contour around the radiating element 212 and aligned in a parallel direction with the radiating element 212. For example, the parasitic elements 214 may also protrude perpendicularly from the planar circular structure 216. The parasitic elements 214 may be equidistant from the radiating element 212. Alternatively, the parasitic elements 214 may be separated from the radiating element 212 by different distances.

The number of parasitic elements 214, referred to herein as N, may be either odd or even. It may be preferable for N to be an odd number. Each of the parasitic elements 214 may be loaded by a reactive load such as a short circuit, an open circuit, an inductive load and/or a capacitive load. The inductive or capacitive loads may be distributed or lumped. The reactive load may be a passive circuit. The circuitry may be simple and of very low cost. The circuitry may be low cost since each of the loads are on the parasitic elements 214 rather than within the RF signal path. Simple circuitry may keep complexity to a minimum. Each of the parasitic elements 214 may have switching capabilities. For example, the parasitic elements 214 may be separated from ground by a switch 218. When the switch 218 is in the open or off position, a parasitic element 214 may act as a director. When the switch 218 is in the closed or on position, a parasitic element 214 may act as a reflector.

When a parasitic element 214 is acting as a reflector and the one dimensional switched beam antenna 220 is transmitting signals 206, the electromagnetic signals received by the parasitic element 214 from the radiating element 212 may be reflected back towards the radiating element 212. The reflected electromagnetic signals may be added in phase to the electromagnetic signals radiated by the radiating element 212 in the direction of a main radiation beam. The main radiation beam may refer to the main or largest lobe of a radiation pattern. The radiation pattern may be a graph of field strength or relative antenna gain as a function of angle. When a parasitic element 214 is acting as a reflector and the one dimensional switched beam antenna 220 is receiving signals, the electromagnetic signals received by the parasitic element 214 from the direction of the radiating element 212 may be reflected back towards the radiating element 212, thereby increasing the signal gain. Furthermore, electromagnetic signals received by the parasitic element 214 from directions other than the radiating element 212 may be reflected away from the radiating element 212, thereby decreasing signal noise received by the radiating element 212. Alternatively, a plurality of parasitic elements 214 may act as reflectors.

When a parasitic element 214 is acting as a director and the one dimensional switched beam antenna 220 is transmitting signals 206, the electromagnetic signals received by the parasitic element 214 from the radiating element 212 may be received and reradiated. The signal reradiated from the parasitic element 214 may be added in phase to the signal radiated from the radiating element 212 in the direction of the main radiation beam, thereby adding to the total transmitted signal. When a parasitic element 214 is acting as a director and the one dimensional switched beam antenna 220 is receiving signals, the electromagnetic signals received by the parasitic element 214 from directions other than that of the radiating element 212 may be absorbed and reradiated in phase, thereby adding to the total signal strength received by the radiating element 212.

By switching the parasitic elements 214 between acting as reflectors and directors, active control of the one dimensional switched beam antenna 220 may be obtained. For example, the one dimensional switched beam antenna 220 may be capable of beam steering over the entire 360 degree azimuth range using different combinations of parasitic elements 214 acting as reflectors and parasitic elements 214 acting as directors. In one configuration, one of the parasitic elements 214 may act as a reflector and the N-1 other parasitic elements 214 may act as directors. Because the reactive loads of the parasitic elements 214 are not in the RF signal path and the center radiating element 212 is fed by a single port, with no power dividing network, losses may be kept to a minimum. N independent beams may be formed by loading the N parasitic elements 214. Additional beams may be formed by superposition of the N independent beams or by the use of a plurality of parasitic elements 214 operating as reflectors.

Figure 2A:
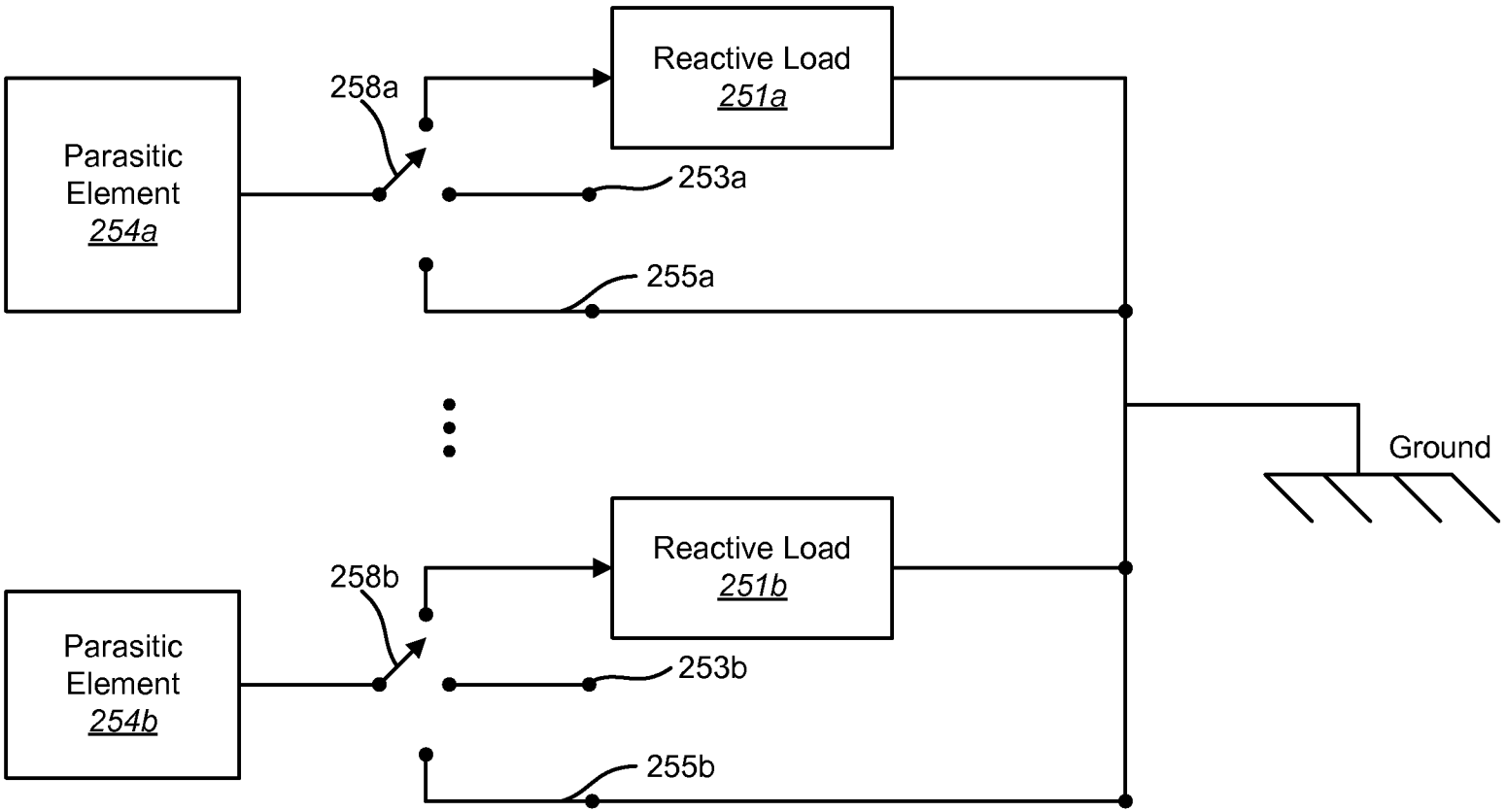
FIG. 2A illustrates switching between parasitic elements, reactive loads, and ground.

FIG. 2A illustrates switching between parasitic elements 254, reactive loads 251, and ground. The parasitic elements 254 of FIG. 2A may be one configuration of the parasitic elements 214 of FIG. 2. Each parasitic element 254*a*, 254*b* may be connected to a switch 258*a*, 258*b*. In one configuration, the switch 258 may be a multiple throw switch. For example, a switch 258 may have a first position, a second position, and a third position. A switch 258 may switch the connection of the parasitic element 254*a*, 254*b* with a short 255*a*, 255*b* between the parasitic element 254*a*, 254*b* and ground in a first position, an open circuit 253*a*, 253*b* between the parasitic element 254*a*, 254*b* and ground in a second position, or a closed circuit between the parasitic element 254*a*, 254*b*, a reactive load 251*a*, 251*b*, and ground in a third position.

A parasitic element 254*a*, 254*b* may act as a reflector with a phase difference when the switch 258*a*, 258*b* is in the third position creating a closed circuit between the parasitic element 254*a*, 254*b*, a reactive load 251*a*, 251*b*, and ground. The phase difference of the reflector may depend on the reactive load 251. In one configuration, a switch 258 may include additional positions creating a closed circuit between the parasitic element 254, another reactive load (not shown), and ground.

Figure 3:
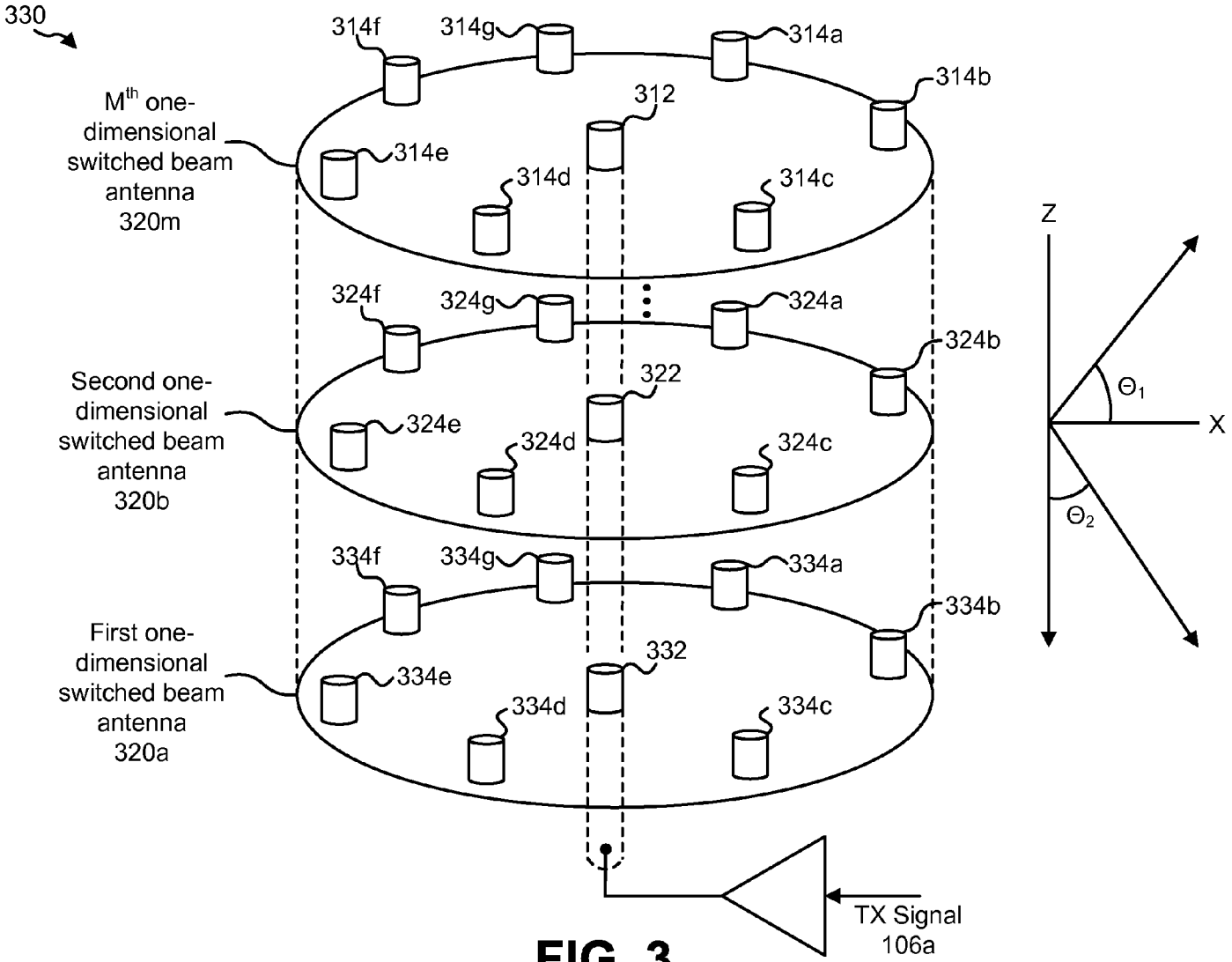
FIG. 3 illustrates a two dimensional steerable beam antenna for use in the present methods and apparatus.

FIG. 3 illustrates a two dimensional steerable beam antenna 330 for use in the present methods. A two dimensional steerable beam antenna 330 may be formed by stacking M (two or more) one dimensional switched beam antennas 320. Each one dimensional switched beam antenna 320 may have a radiating element 312, 322, 332 surrounded by N parasitic elements 314, 324, 334 on a circular planar structure 216. Each one dimensional switched beam antenna 320 may have the same number N of parasitic elements 314, 324, 334 in the same configuration on each planar circular structure 216. For example, each one dimensional switched beam antenna 320 in FIG. 3 has seven parasitic elements 314, 324, 334. Each of the stacked one dimensional switched beam antennas 320 may be separated by a distance of one half to one wavelength.

By stacking M one dimensional switched beam antennas 320 in a direction perpendicular to the antenna planes, each of the one dimensional switched beam antennas 320 may be used as an element in an M-element vertical phased array. An M-element vertical phased array may also be referred to as a two dimensional steerable beam antenna. In an M-element vertical phased array, each of the individual one dimensional switched beam antennas 320 may be vertically aligned such that the parasitic elements line up. For example, parasitic element 314*a* may be directly above parasitic element 324*a* which may be directly above parasitic element 334*a*. Each of the individual one dimensional switched beam antennas 320 may also be configured to form the same horizontal beam. Thus, each one dimensional switched beam antenna 320 may use the same switching scheme for the parasitic elements 314, 324, 334. By aligning each of the one dimensional switched beam antennas 320, a vertical phase array of M elements is formed and by feeding each of the M vertical elements with appropriate phase, a narrower and scannable beam may be formed in elevation.

By feeding each of the M vertical elements of the two dimensional steerable beam antenna 330 with the appropriate phases, elevation beam steering may be attained. A vertically scanned beam is produced by a progressive phase shift between adjacent vertical elements 314, 324, 334. This phase shift may be achieved by a conventional phased array feed with digital phase shifters or by a switching mechanism that is connected to a bootlace lens, such as a Rotman lens or a Butler matrix. Simplicity of this feed network is afforded by the inherent limited angular coverage in elevation.

Figure 4:
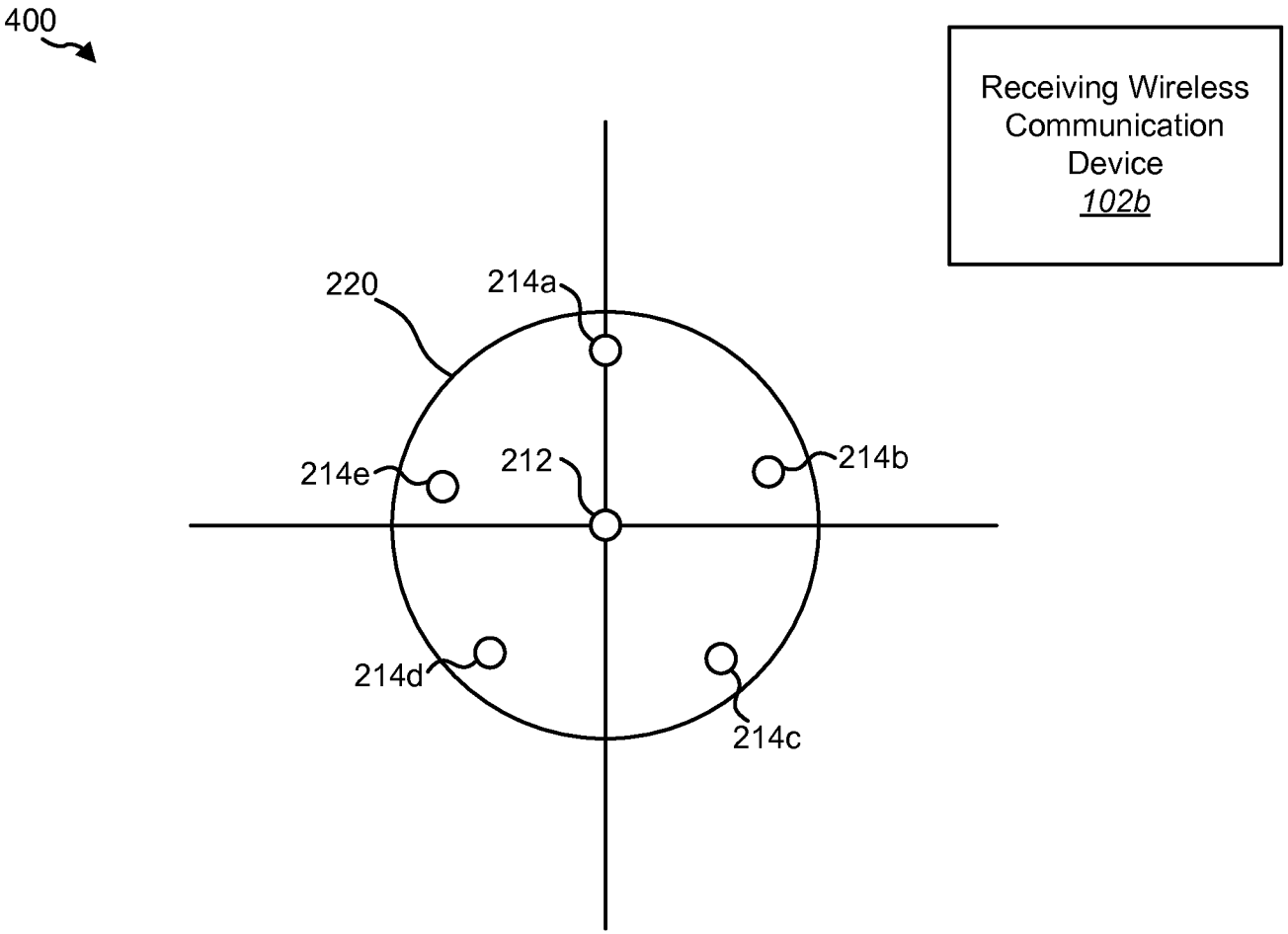
FIG. 4 shows a wireless communication system with a one dimensional switched beam antenna and a receiving wireless communication device.

FIG. 4 shows a wireless communication system 400 with a one dimensional switched beam antenna 220 and a receiving wireless communication device 102*b*. The one dimensional switched beam antenna 220 may include a radiating element 212 and one or more parasitic elements 214. For example, the one dimensional switched beam antenna 220 shown has five parasitic elements 214. Although the one dimensional switched beam antenna 220 is shown acting as a transmitting antenna, the one dimensional switched beam antenna 220 may be equally operative as a receiving antenna.

The one dimensional switched beam antenna 220 may operate as part of a two dimensional steerable beam antenna 330. Thus, although only a single one dimensional switched beam antenna 220 is shown in the figure, additional one dimensional switched beam antennas 220 may be stacked above or below the single one dimensional switched beam antenna 220 with similar horizontal steering functionality. Although it is not shown in the figure, the one dimensional switched beam antenna 220 and/or the two dimensional steerable beam antenna 330 may operate as part of a wireless communication device 102*a*.

The link budget for transmitting a high data rate over the 60 GHz frequency band may require considerable antenna gain as well as flexibility in the orientation of the end point devices. In other words, it may be beneficial for the one dimensional switched beam antenna 220 to direct transmissions towards the receiving wireless communication device 102*b* and/or for the receiving wireless communication device 102*b* to direct the angle of reception.

The receiving wireless communication device 102*b* may use a one dimensional switched beam antenna 220 to receive transmissions, thereby allowing the receiving wireless communication device 102*b* to steer the direction of reception to optimize the received signal gain. Alternatively, the receiving wireless communication device 102*b* may use any antenna suitable for receiving wireless transmissions.

To achieve flexibility in the orientation of the wireless devices, a narrow beam antenna with beam steering capability over a wide range in azimuth and elevation may be suitable. The one dimensional switched beam antenna 220 shown in FIG. 4 may be capable of beam steering over 360 degrees in azimuth. A number of options of antenna gain and steering capabilities may be possible by appropriate selection of the number of parasitic elements 214 used in the one dimensional switched beam antenna 220. A discrete number of switchable beams covering the 360 degree horizontal field of view may be produced according to the number of parasitic elements 214 used. For example, N discrete switchable beams may be produced, each covering a different portion of the 360 degree horizontal field, using N parasitic elements 214 in the one dimensional switched beam antenna 220.

Figure 5:
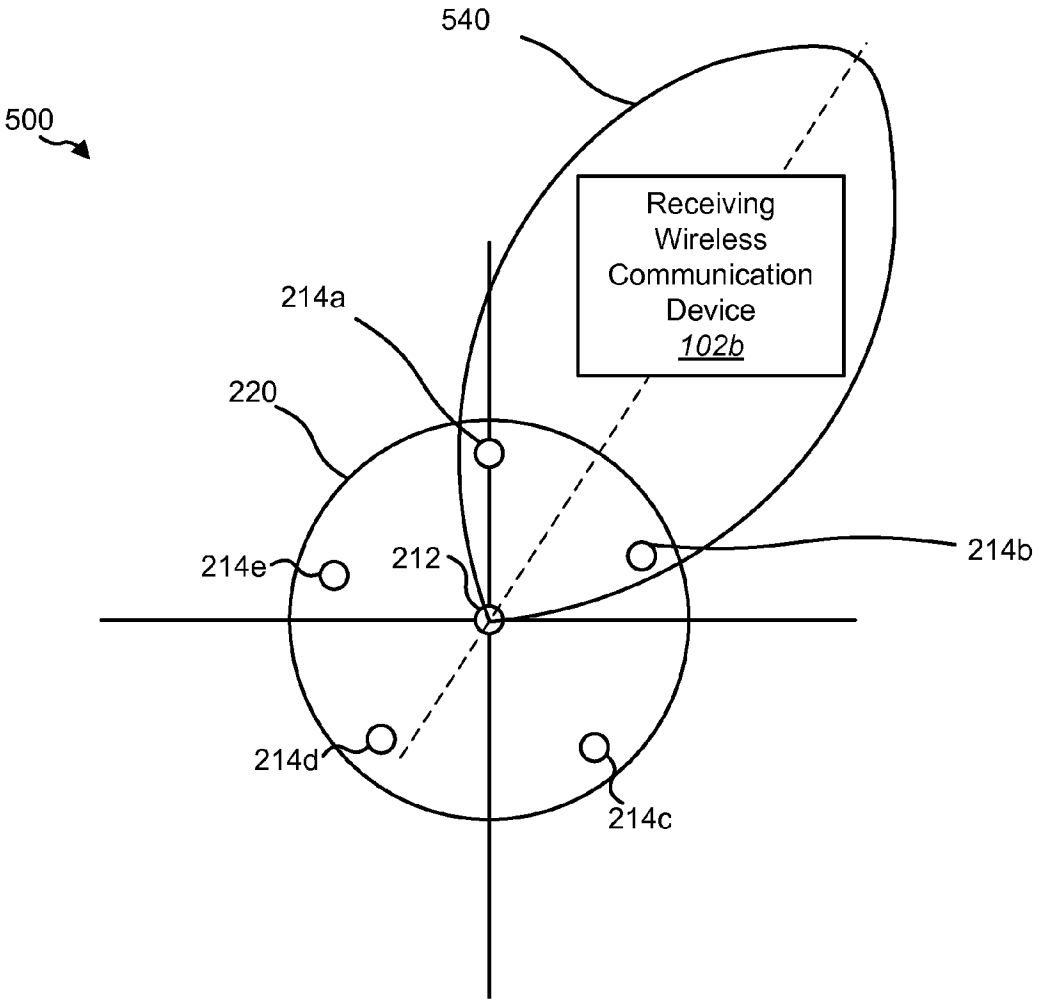
FIG. 5 shows a wireless communication system with a one dimensional switched beam antenna directing transmissions towards a receiving wireless communication device.

FIG. 5 shows a wireless communication system 500 with a one dimensional switched beam antenna 220 directing transmissions 540 towards a receiving wireless communication device 102*b*. The one dimensional switched beam antenna 220 may include five parasitic elements 214. To steer the transmissions 540 of the one dimensional switched beam antenna 220 towards the receiving wireless communication device 102*b*, the switches 218 on the one dimensional switched beam antenna 220 may be adjusted. For example, the switch S4 218*d* may be closed, thereby shorting parasitic element 214*d* to ground. Parasitic element 214*d* may then act as a reflector. Likewise, the switches 218*a*, 218*b*, 218*c* and 218*e* may each be open, thereby creating an open circuit between parasitic elements 214*a*, 214*b*, 214*c* and 214*e* and ground. Alternatively, parasitic elements 214*a*, 214*b*, 214*c* and 214*d* may be connected by the switch to lumped or distributed reactive loads. Parasitic elements 214*a*, 214*b*, 214*c* and 214*e* may thus act as directors for signals transmitted by the radiating element. The signals transmitted 540 by the radiating element 212 may thus be directed away from parasitic element 214*d* acting as a reflector. Reflectors and directors were discussed in more detail above in relation to FIG. 2.

Figure 6:
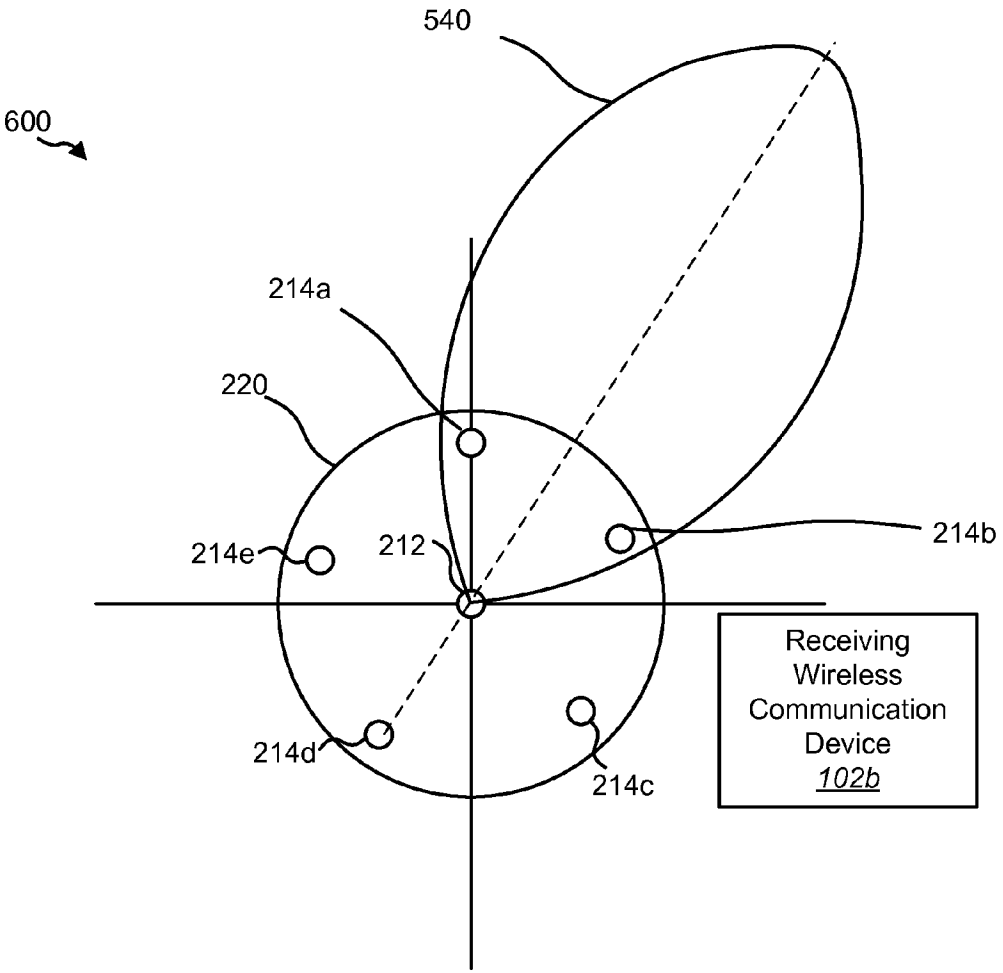
FIG. 6 shows a wireless communication system with a one dimensional switched beam antenna directing transmissions towards the previous location of a receiving wireless communication device that has moved outside of the directed signal transmission path.

FIG. 6 shows a wireless communication system 600 with a one dimensional switched beam antenna 220 directing transmissions 640 towards the previous location of a receiving wireless communication device 102*b* that has moved outside of the directed signal transmission 640 path. The one dimensional switched beam antenna 220 may be directing signal transmissions 640 towards the previous location of the receiving wireless communication device 102*b*. Thus, parasitic element 214*d* may be acting as a reflector while parasitic elements 214*a*, 214*b*, 214*c* and 214*e* are acting as directors. It may be beneficial for the one dimensional switched beam antenna 220 to redirect transmissions 640 towards the current location of the receiving wireless communication device 102*b*. To redirect transmissions 640 towards the current location of the receiving wireless communication device 102*b*, a different combination of parasitic elements 214 acting as reflectors and parasitic elements 214 acting as directors may be used.

Figure 7:
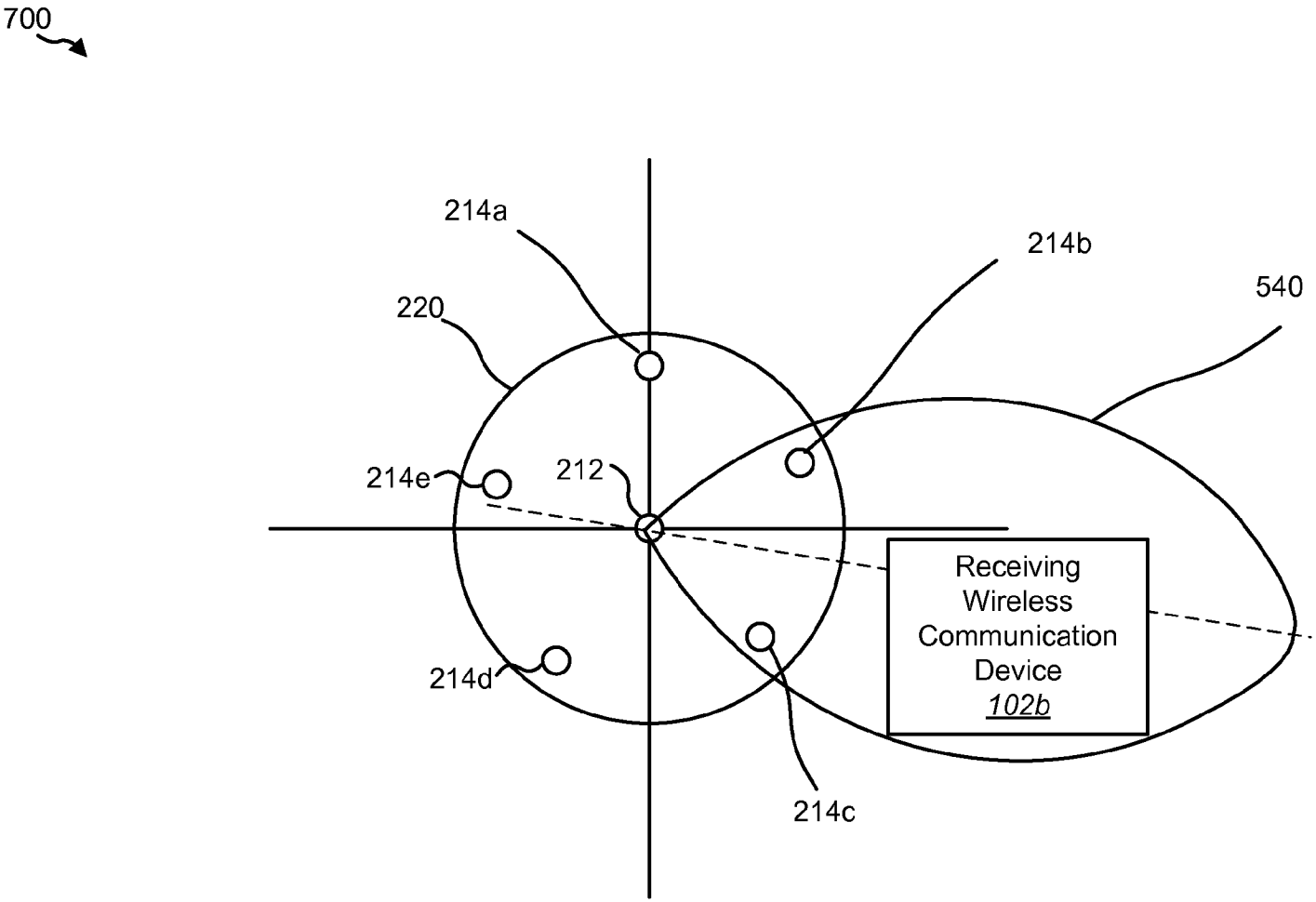
FIG. 7 shows a wireless communication system with a one dimensional switched beam antenna having adjusted the direction of transmission towards the new location of a receiving wireless communication device.

FIG. 7 shows a wireless communication system 700 with a one dimensional switched beam antenna 220 having adjusted the direction of transmission 740 towards the new location of a receiving wireless communication device 102*b*. Based on the new location of the receiving wireless communication device 102*b*, the one dimensional switched beam antenna 220 may adjust the configuration of parasitic elements 214 acting as reflectors and parasitic elements 214 acting as directors. For example, the switch S5 218*e* may be closed, thereby creating a short between parasitic element 214*e* and ground. Parasitic element 214*e* may act as a reflector. The switches S1-S4 218*a-d* may each be open, thereby creating an open circuit between parasitic elements 214*a-d* and ground. Alternatively, parasitic elements 214*a-d* may be connected by the switch to lumped or distributed reactive loads. Parasitic elements 214*a-d* may then act as directors. Based on the new configuration of parasitic elements 214 acting as reflectors and parasitic elements 214 acting as directors, the one dimensional switched beam antenna 220 may direct transmissions 740 from the radiating element 212 towards the receiving wireless communication device 102*b*.

Figure 8:
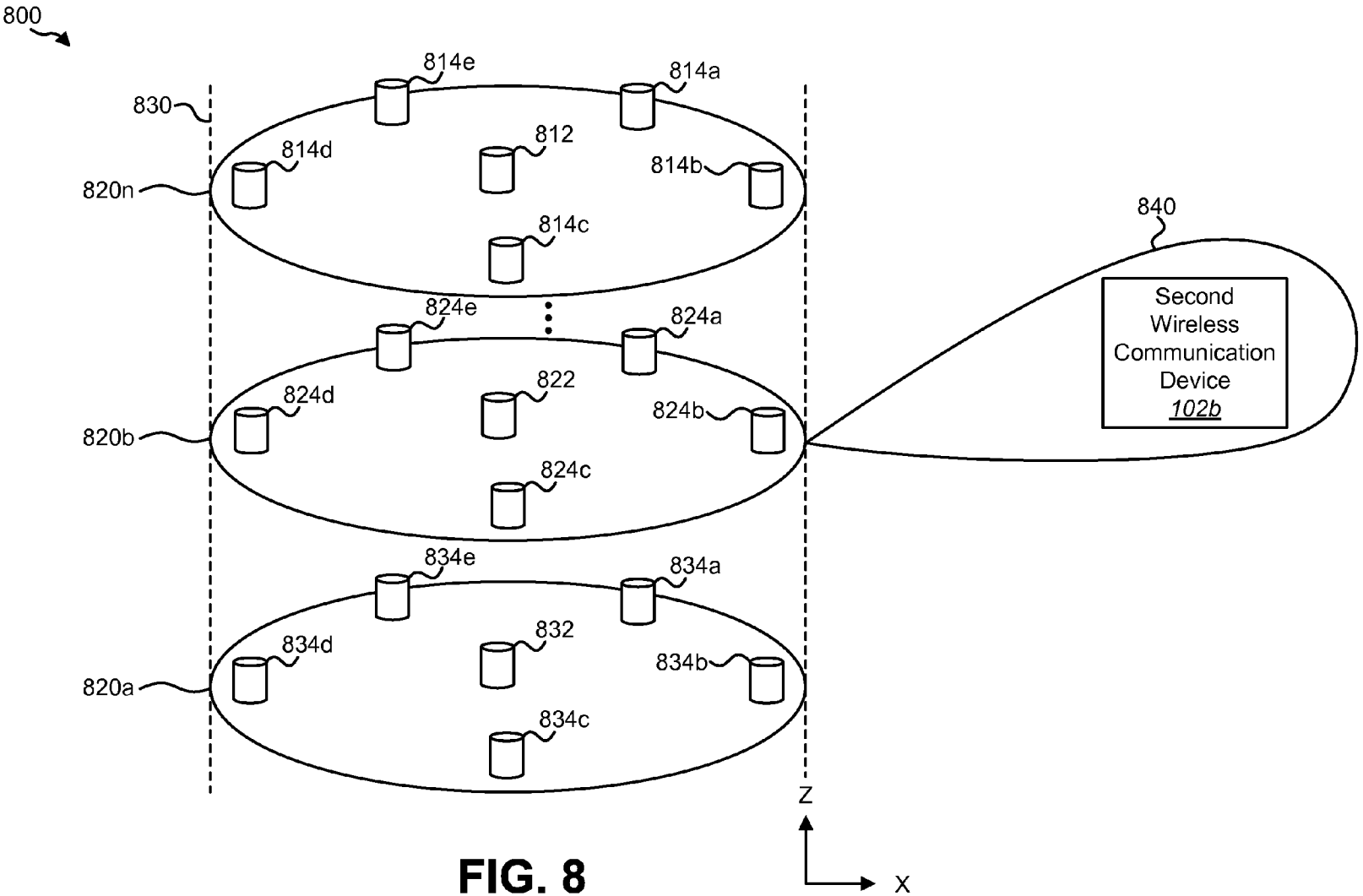
FIG. 8 shows a wireless communication system with an M-element vertical phased array and a receiving wireless communication device.

FIG. 8 shows a wireless communication system 800 with an M-element vertical phased array 830 and a receiving wireless communication device 102*b*. The M-element vertical phased array 830 may include M one dimensional switched beam antennas 820 stacked in a direction perpendicular to the antenna planes. Each of the one dimensional switched beam antennas 820 may include the same number of radiating elements 812, 822, 832 and parasitic elements 814, 824, 834. For example, in the figure, each one dimensional switched beam antenna 820 includes one radiating element 812, 822, 832 surrounded by five parasitic elements 813, 824, 834. The parasitic elements 814, 824, 834 may be vertically aligned. For example, the parasitic element 824*a* on the second one dimensional switched beam antenna 820*b* may be directly above the parasitic element 834*a* on the first one dimensional switched beam antenna 820*a*.

Each of the parasitic elements 814, 824, 834 on each of the one dimensional switched beam antennas 820 may include a switch and reactive circuitry between the parasitic element 814, 824, 834 and ground. Vertically aligned parasitic elements 814, 824, 834 may use similar reactive circuitry. Alternatively, vertically aligned parasitic elements may share the reactive circuitry. For example, parasitic element 814*a* may share one reactive circuit with parasitic element 824*a* and parasitic element 834*a*.

Each of the one dimensional switched beam antennas 820 in the vertical phased array antenna 830 may be synchronized. For example, each of the one dimensional switched beam antennas 820 in the vertical phased array antenna 830 may use the same configuration of parasitic elements 814, 824, 834 acting as reflectors and parasitic elements 814, 824, 834 acting as directors. Thus, if the parasitic element 814*a* is switched to act as a reflector by creating a short between the parasitic element 814*a* and ground using a switch, parasitic element 824*a* and parasitic element 834*a* may also be switched to act as reflectors by creating a short between parasitic element 824*a* and ground and a short between parasitic element 834*a* and ground.

As with a single one dimensional switched beam antenna 820, each parasitic element 814, 824, 834 of each one dimensional switched beam antenna 820 in the vertical phased array antenna 830 may act as either a reflector or a director, thereby allowing the vertical phased array antenna 830 to direct transmissions covering the 360 degree horizontal field of view. For example, the parasitic elements 814*d*, 824*d*, and 834*d* may each be shorted to ground so that the parasitic elements 814*d*, 824*d* and 834*d* each act as reflectors. The other parasitic elements 814, 824, 834 of each one dimensional switched beam antenna 830 in the vertical phased array antenna 830 may have an open circuit between the parasitic element 814, 824, 834 and ground. Therefore, the other parasitic elements 814, 824, 834 of each one dimensional switched beam antenna 820 may each act as directors. The vertical phased array antenna 830 may thus steer transmissions 840 over the 360 degree azimuth towards the receiving wireless communication device 102*b*.

The receiving wireless communication device 102*b* may be located at a different elevation than the vertical phased array antenna 830. It may thus be advantageous for the vertical phased array antenna 830 to provide elevation steering in addition to the 360 degree azimuth steering. The vertical phased array antenna 830 may achieve almost 180 degrees of elevation steering by feeding each of the radiating elements 812, 822, 832 of the vertical phased array antenna with the appropriate phase.

Transmission signals may be combined by the vertical phased array antenna 830. For example, the transmission signals for each one dimensional switched beam antennas 820 may be digitally split and digitally combined. To digitally split the transmission signals, the transmit signal may be split into phase different streams for transmission. The phase shifted streams may then be combined for reception. Both digitally splitting and digitally combining the transmission signals may take place in the baseband and may be performed in the complex domain. The combining and splitting may also take place near the transmit and receive antennas at the antenna frequency or at an intermediate frequency (IF). In both cases, the operations may be in the real analog domain.

Figure 9:
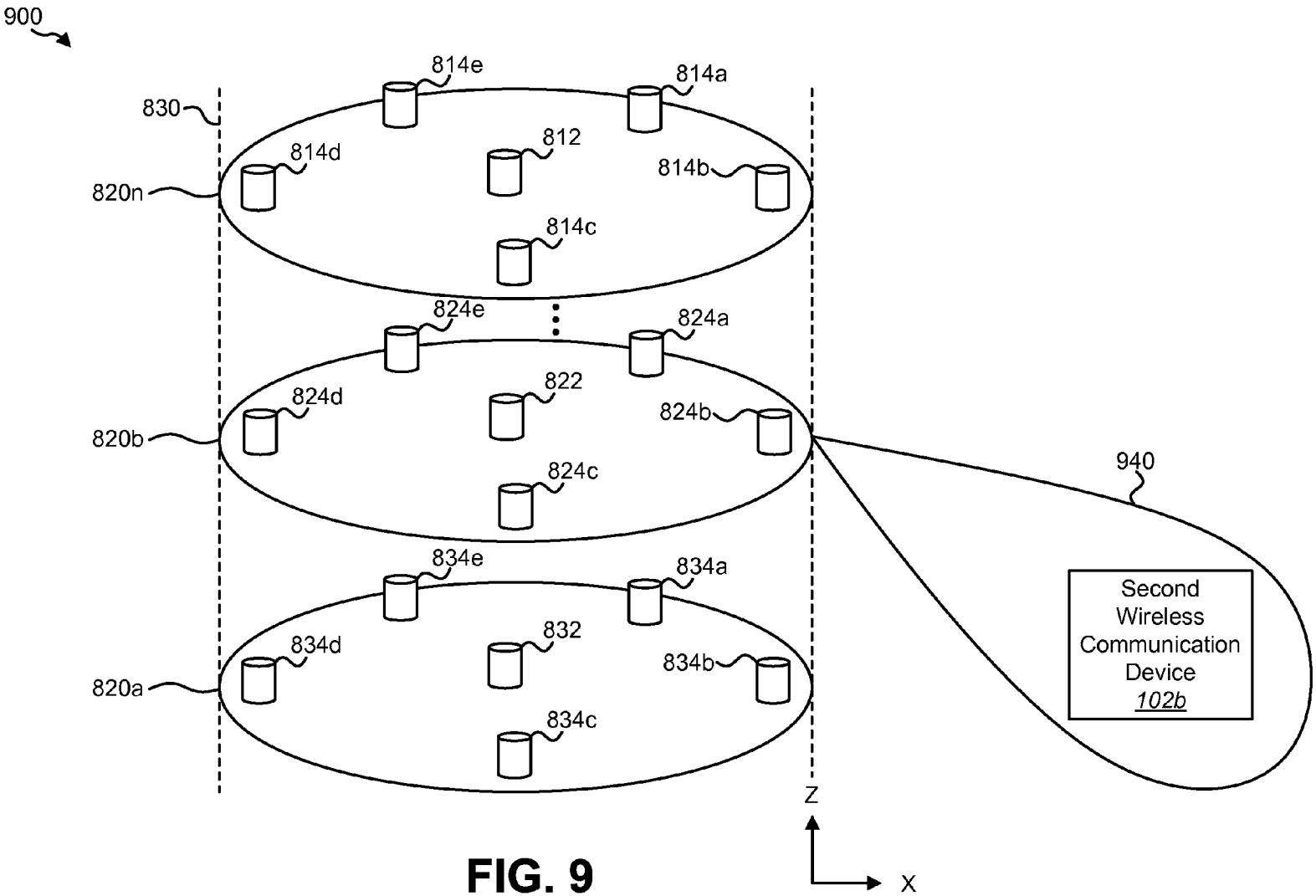
FIG. 9 shows a wireless communication system with an M-element vertical phased array and a receiving wireless communication device with a recently changed elevation.

FIG. 9 shows a wireless communication system 900 with an M-element vertical phased array antenna 830 and a receiving wireless communication device 102*b* with a recently changed elevation. Because the M-element vertical phased array antenna 830 is capable of almost 180 degrees in elevation steering, the transmission beam 940 may be directed towards the location of the receiving wireless communication device 102*b* despite changes in elevation of the receiving wireless communication device 102*b*. Thus, the M-element vertical phased array antenna 830 may more accurately direct transmissions 940 towards the receiving wireless communication device 102*b*, thereby improving the link budget between the M-element vertical phased array antenna 830 and the receiving wireless communication device 102*b*.

Figure 10:
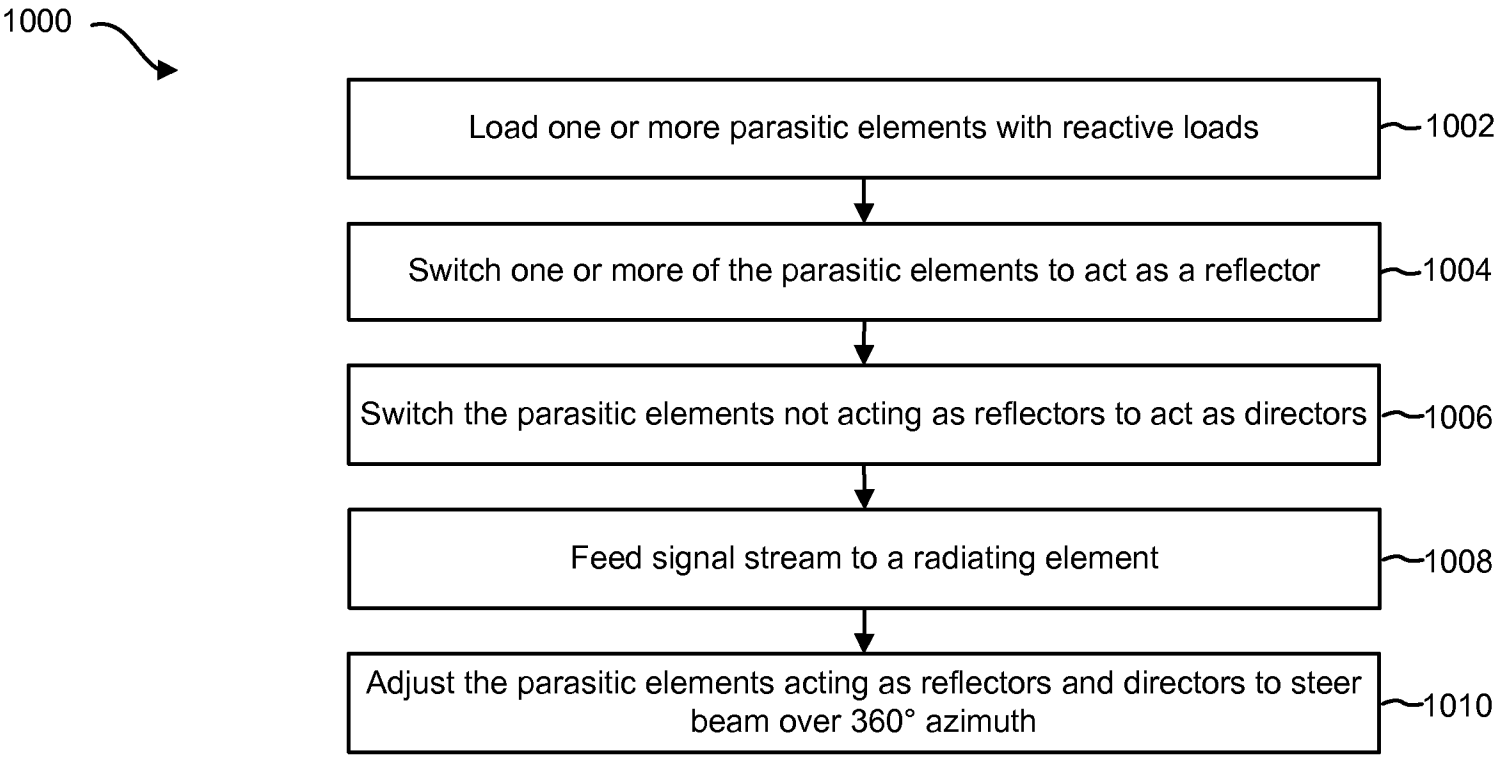
FIG. 10 is a flow diagram illustrating a method for beam steering using a one dimensional switched beam antenna.

FIG. 10 is a flow diagram illustrating a method 1000 for beam steering using a one dimensional switched beam antenna 220. The one dimensional switched beam antenna 220 may load 1002 one or more parasitic elements 214 with reactive loads. The reactive loads may be inductive and/or capacitive. The one dimensional switched beam antenna 220 may then switch 1004 one or more of the parasitic elements 214 to act as a reflector. The one dimensional switched beam antenna 220 may switch a parasitic element 214 to act as a reflector by shorting the parasitic element 214 to ground. The one dimensional switched beam antenna 220 may switch 1006 the parasitic elements 214 that are not acting as reflectors to act as directors. The one dimensional switched beam antenna 220 may switch a parasitic element 214 to act as a director by creating an open circuit between the parasitic element 214 and ground.

The one dimensional switched beam antenna 220 may then feed 1008 a signal stream to a radiating element 212. The one dimensional switched beam antenna 220 may adjust 1010 the parasitic elements 214 acting as reflectors and directors to steer the beam over the 360 degree azimuth. For example, the one dimensional switched beam antenna 220 may switch certain parasitic elements 214 from acting as directors to acting as reflectors and certain parasitic elements 214 from acting as reflectors to acting as directors, according to the location of the destination device.

Figure 10A:
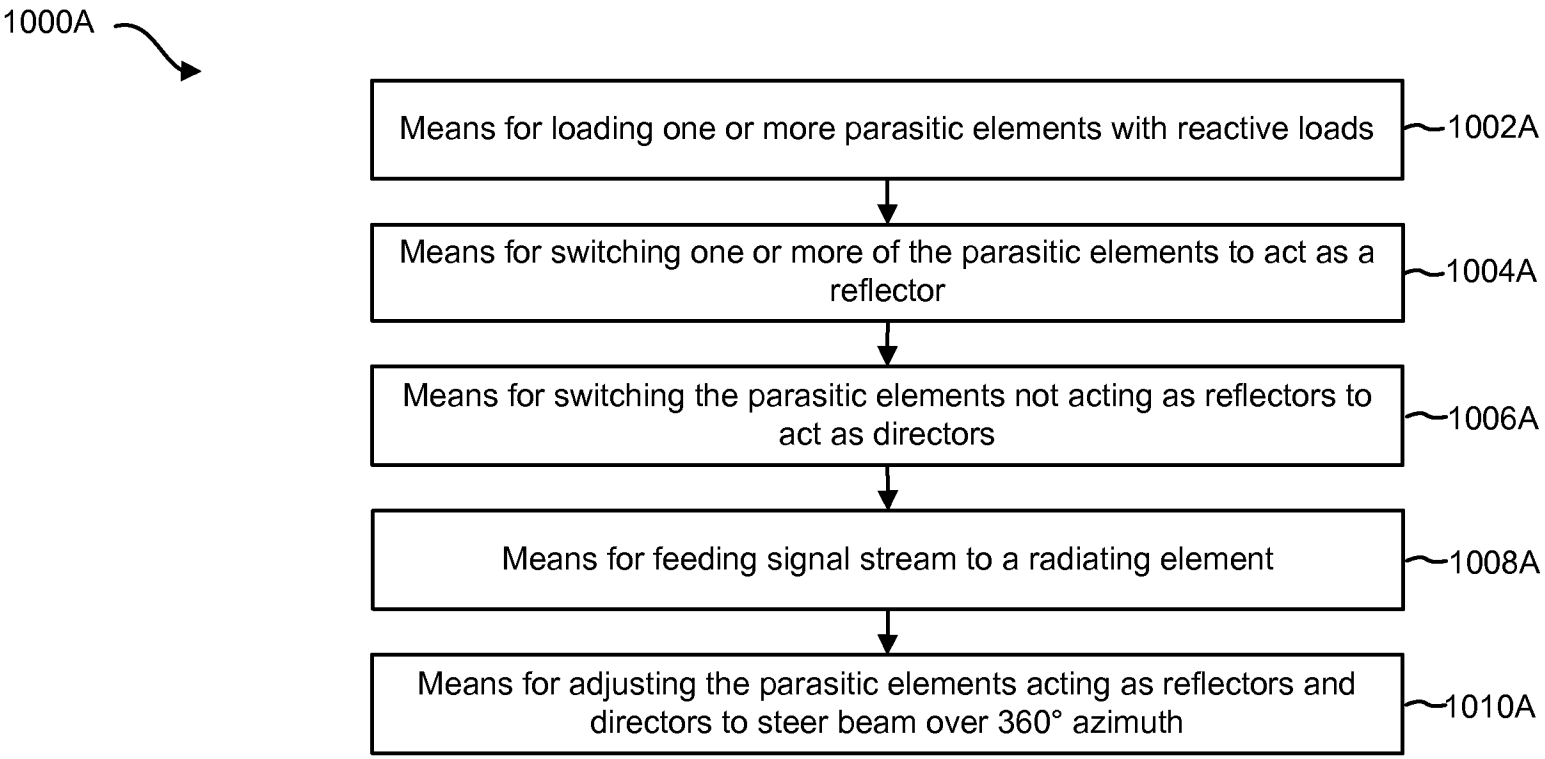
FIG. 10A illustrates means-plus-function blocks corresponding to the method of FIG. 10.

The method 1000 of FIG. 10 described above may be performed by various hardware and/or software component(s) and/or module(s) corresponding to the means-plus-function blocks 1000A illustrated in FIG. 10A. In other words, blocks 1002 through 1010 illustrated in FIG. 10 correspond to means-plus-function blocks 1002A through 1010A illustrated in FIG. 10A.

Figure 11:
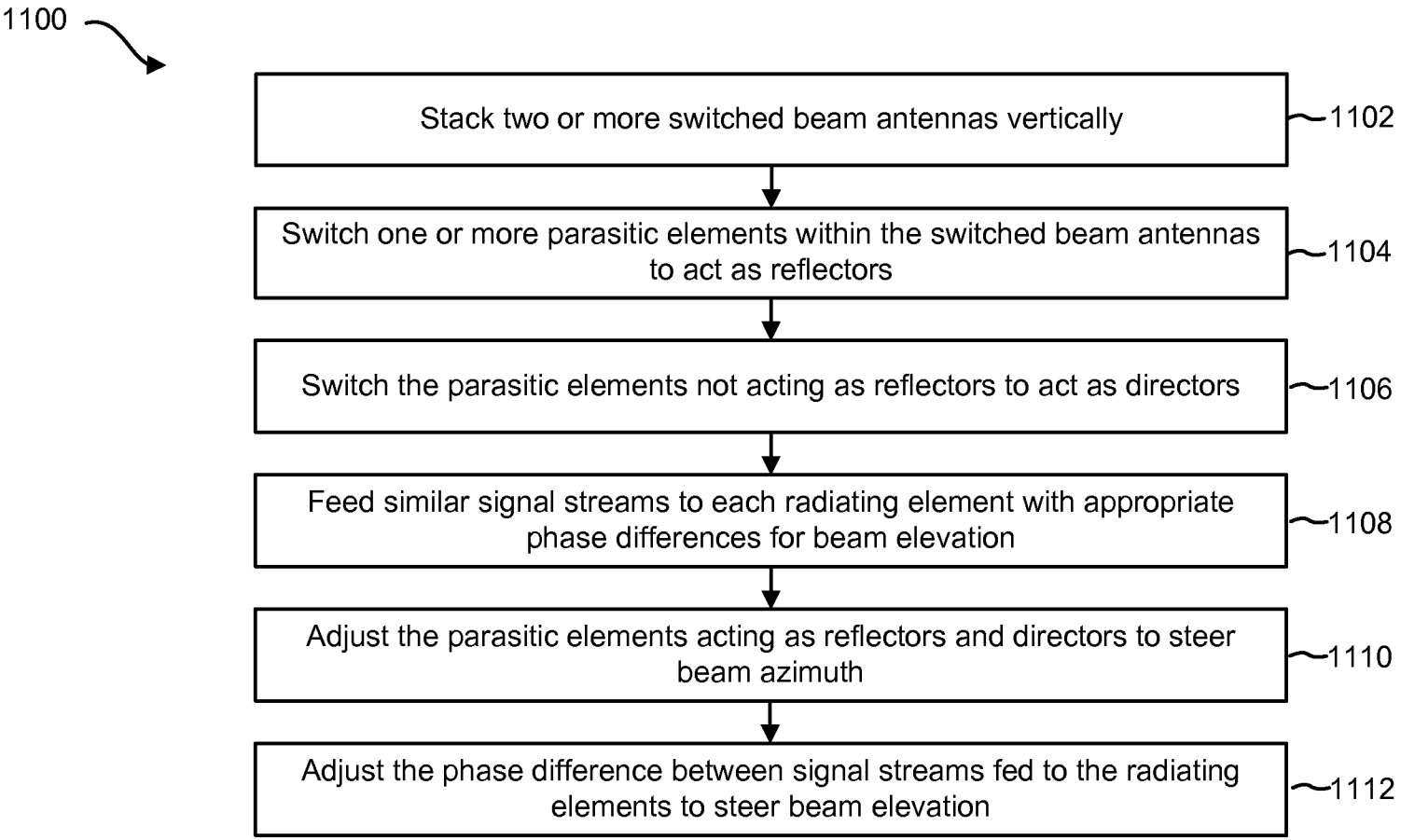
FIG. 11 is a flow diagram illustrating a method for beam steering over 360 degrees in azimuth and almost 180 degrees in elevation using a two dimensional steerable beam antenna.

FIG. 11 is a flow diagram illustrating a method 1100 for beam steering over 360 degrees in azimuth and almost 180 degrees in elevation using a two dimensional steerable beam antenna 330. A two dimensional steerable beam antenna 330 may be formed by stacking 1102 two or more one dimensional switched beam antennas 220 vertically. As discussed above, a two dimensional steerable beam antenna 330 may also be referred to as an M-element vertical phased array antenna. The two dimensional steerable beam antenna 330 may then switch 1104 one or more parasitic elements 314, 324, 334 within each of the one dimensional switched beam antennas 220 to act as reflectors. A parasitic element 314, 324, 334 may act as a reflector when the parasitic element 314, 324, 334 is shorted to ground. The two dimensional steerable beam antenna 330 may then switch 1106 the parasitic elements 314, 324, 334 not acting as reflectors to act as directors. A parasitic element 314, 324, 334 may act as a director when a switch between the parasitic element 314, 324, 334 and ground is open, such that there is an open circuit between the parasitic element 314, 324, 334 and ground.

The two dimensional steerable beam antenna 330 may then feed 1108 similar signal streams 106 to each radiating element 312, 322, 332 of each one dimensional switched beam antenna 320. There may be a controlled phase difference between any two consecutive radiating elements that determines the direction in elevation of the steerable beam. The radiating element 312, 322, 332 may transmit the signal stream 106 as electromagnetic waves. The two dimensional steerable beam antenna 330 may adjust 1110 the parasitic elements 314, 324, 334 acting as reflectors and directors to steer the beam azimuth. The two dimensional steerable beam antenna 330 may then adjust 1112 the phase difference between the signal streams fed to the radiating elements 312, 322, 332 to steer the beam elevation.

Figure 11A:
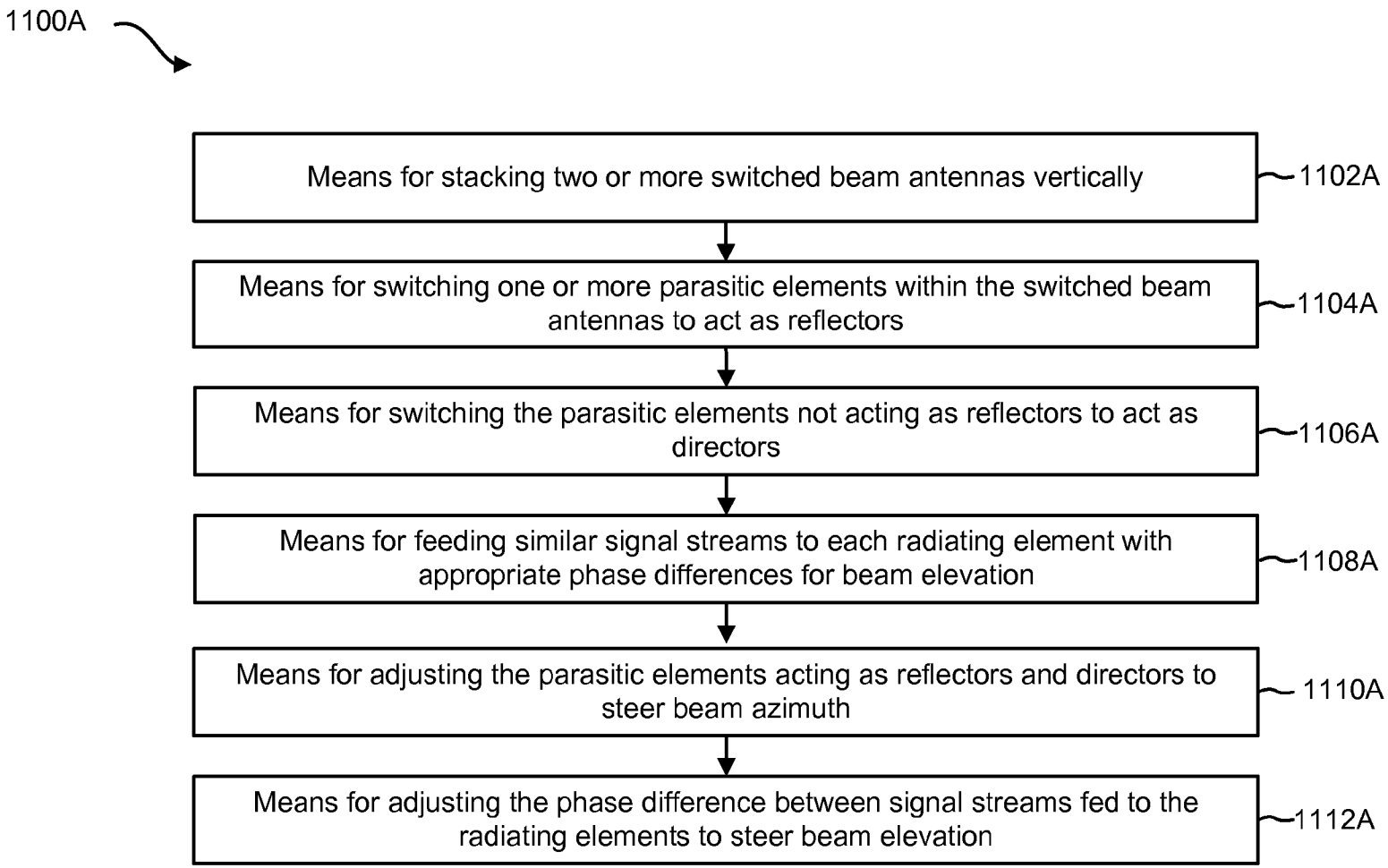
FIG. 11A illustrates means-plus-function blocks corresponding to the method of FIG. 11.

The method 1100 of FIG. 11 described above may be performed by various hardware and/or software component(s) and/or module(s) corresponding to the means-plus-function blocks 1100A illustrated in FIG. 11A. In other words, blocks 1102 through 1112 illustrated in FIG. 11 correspond to means-plus-function blocks 1102A through 1112A illustrated in FIG. 11A.

Figure 12:
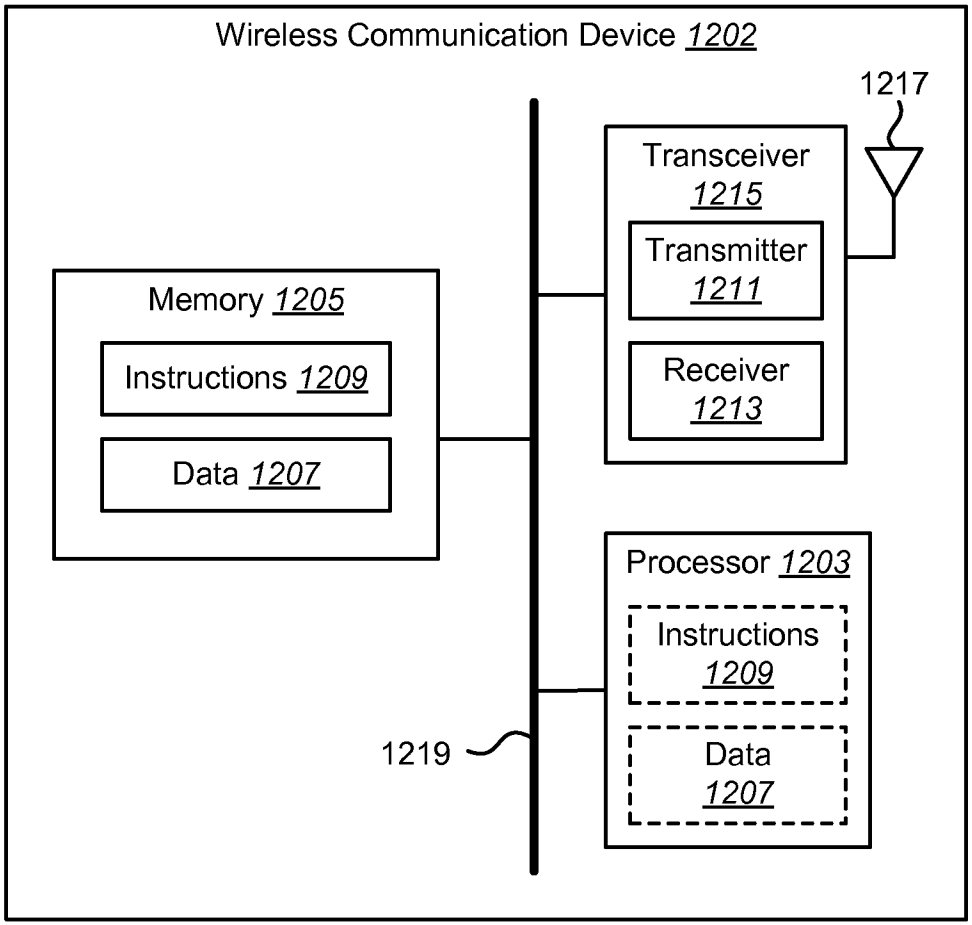
FIG. 12 illustrates certain components that may be included within a wireless communication device.

FIG. 12 illustrates certain components that may be included within a wireless communication device 1202. The wireless communication device 1202 includes a processor 1203. The processor 1203 may be a general purpose single- or multi-chip microprocessor (e.g., an ARM), a special purpose microprocessor (e.g., a digital signal processor (DSP)), a microcontroller, a programmable gate array, etc. The processor 1203 may be referred to as a central processing unit (CPU). Although just a single processor 1203 is shown in the wireless communication device 1202 of FIG. 12, in an alternative configuration, a combination of processors (e.g., an ARM and DSP) could be used.

The wireless communication device 1202 also includes memory 1205. The memory 1205 may be any electronic component capable of storing electronic information. The memory 1205 may be embodied as random access memory (RAM), read only memory (ROM), magnetic disk storage media, optical storage media, flash memory devices in RAM, on-board memory included with the processor, EPROM memory, EEPROM memory, registers, and so forth, including combinations thereof.

Data 1207 and instructions 1209 may be stored in the memory 1205. The instructions 1209 may be executable by the processor 1203 to implement the methods disclosed herein. Executing the instructions 1209 may involve the use of the data 1207 that is stored in the memory 1205.

The wireless communication device 1202 may also include a transmitter 1211 and a receiver 1213 to allow transmission and reception of signals between the wireless communication device 1202 and a remote location. The transmitter 1211 and receiver 1213 may be collectively referred to as a transceiver 1215. An antenna 1217 may be electrically coupled to the transceiver 1215. The wireless communication device 1202 may also include (not shown) multiple transmitters, multiple receivers, multiple transceivers and/or multiple antenna.

The various components of the wireless communication device 1202 may be coupled together by one or more buses, which may include a power bus, a control signal bus, a status signal bus, a data bus, etc. For the sake of clarity, the various buses are illustrated in FIG. 12 as a bus system 1219.

The techniques described herein may be used for various communication systems, including communication systems that are based on an orthogonal multiplexing scheme. Examples of such communication systems include Orthogonal Frequency Division Multiple Access (OFDMA) systems, Single-Carrier Frequency Division Multiple Access (SC-FDMA) systems, and so forth. An OFDMA system utilizes orthogonal frequency division multiplexing (OFDM), which is a modulation technique that partitions the overall system bandwidth into multiple orthogonal sub-carriers. These sub-carriers may also be called tones, bins, etc. With OFDM, each sub-carrier may be independently modulated with data. An SC-FDMA system may utilize interleaved FDMA (IFDMA) to transmit on sub-carriers that are distributed across the system bandwidth, localized FDMA (LFDMA) to transmit on a block of adjacent sub-carriers, or enhanced FDMA (EFDMA) to transmit on multiple blocks of adjacent sub-carriers. In general, modulation symbols are sent in the frequency domain with OFDM and in the time domain with SC-FDMA.

The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

The term "processor" should be interpreted broadly to encompass a general purpose processor, a central processing unit (CPU), a microprocessor, a digital signal processor (DSP), a controller, a microcontroller, a state machine, and so forth. Under some circumstances, a "processor" may refer to an application specific integrated circuit (ASIC), a programmable logic device (PLD), a field programmable gate array (FPGA), etc. The term "processor" may refer to a combination of processing devices, e.g., a combination of a DSP and a microprocessor, a plurality of microprocessors, one or more microprocessors in conjunction with a DSP core, or any other such configuration.

The term "memory" should be interpreted broadly to encompass any electronic component capable of storing electronic information. The term memory may refer to various types of processor-readable media such as random access memory (RAM), read-only memory (ROM), non-volatile random access memory (NVRAM), programmable read-only memory (PROM), erasable programmable read only memory (EPROM), electrically erasable PROM (EEPROM), flash memory, magnetic or optical data storage, registers, etc. Memory is said to be in electronic communication with a processor if the processor can read information from and/or write information to the memory. Memory that is integral to a processor is in electronic communication with the processor.

The terms "instructions" and "code" should be interpreted broadly to include any type of computer-readable statement (s). For example, the terms "instructions" and "code" may refer to one or more programs, routines, sub-routines, functions, procedures, etc. "Instructions" and "code" may comprise a single computer-readable statement or many computer-readable statements.

The functions described herein may be implemented in hardware, software, firmware, or any combination thereof. If implemented in software, the functions may be stored as one or more instructions on a computer-readable medium. The term "computer-readable medium" refers to any available medium that can be accessed by a computer. By way of example, and not limitation, a computer-readable medium may comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray® disc where disks usually reproduce data magnetically, while discs reproduce data optically with lasers.

Software or instructions may also be transmitted over a transmission medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of transmission medium.

The methods disclosed herein comprise one or more steps or actions for achieving the described method. The method steps and/or actions may be interchanged with one another without departing from the scope of the claims. In other words, unless a specific order of steps or actions is required for proper operation of the method that is being described, the order and/or use of specific steps and/or actions may be modified without departing from the scope of the claims.

Further, it should be appreciated that modules and/or other appropriate means for performing the methods and techniques described herein, such as those illustrated by FIGS. 10 and 11, can be downloaded and/or otherwise obtained by a device. For example, a device may be coupled to a server to facilitate the transfer of means for performing the methods described herein. Alternatively, various methods described herein can be provided via a storage means (e.g., random access memory (RAM), read only memory (ROM), a physical storage medium such as a compact disc (CD) or floppy disk, etc.), such that a device may obtain the various methods upon coupling or providing the storage means to the device. Moreover, any other suitable technique for providing the methods and techniques described herein to a device can be utilized.

It is to be understood that the claims are not limited to the precise configuration and components illustrated above. Various modifications, changes and variations may be made in the arrangement, operation and details of the systems, methods, and apparatus described herein without departing from the scope of the claims.

What is claimed is

1. An antenna comprising:

a first planar circular structure;

a radiating element located at a center of the first planar circular structure;

one or more first parasitic elements located on a contour around the radiating element, wherein the one or more first parasitic elements are aligned in a parallel direction with the radiating element and wherein the one or more first parasitic elements protrude from the first planar circular structure; and one or more first switches, each first switch of the one or more first switches separating a corresponding parasitic element of the one or more first parasitic elements from ground, wherein each of the first switches is configured to selectively disconnect the corresponding parasitic element from ground.

2. The antenna of claim 1, wherein the corresponding parasitic element acts as a reflector when the first switch connects the corresponding parasitic element and ground.

3. The antenna of claim 1, wherein the corresponding parasitic element acts as a director when the first switch disconnects the parasitic element from ground.

4. The antenna of claim 1, wherein the corresponding parasitic element acts as a reflector with a phase difference when the first switch connects the corresponding parasitic element, a reactive load, and ground.

5. The antenna of claim 1, wherein the antenna is a dipole antenna, wherein the first planar circular structure includes a non-conductive material, and wherein the radiating element and each of the one or more first parasitic elements protrude perpendicularly from the first planar circular structure in both directions.

6. The antenna of claim 1, wherein the antenna is a monopole antenna, wherein the first planar circular structure includes a conductive material tied to ground, and wherein the radiating element and each of the one or more first parasitic elements protrude perpendicularly from the first planar circular structure in one direction.

7. The antenna of claim 1, wherein the one or more first switches enable active beam steering control of the antenna over a 360 degree azimuth by selectively disconnecting a subset of the one or more first parasitic elements from ground to produce a discrete number of switchable beams.

8. The antenna of claim 1, further comprising:

a second planar circular structure stacked perpendicular to the first planar circular structure, wherein a same number of one or more second parasitic elements protrude from the second planar circular structure as a number of the one or more first parasitic elements that protrude from the first planar circular structure; and one or more second switches, wherein each second switch corresponds to a particular first switch of the one or more first switches, selectively isolates a corresponding second parasitic element of the one or more second parasitic elements from ground, and has a same configuration as the particular first switch.

9. The antenna of claim 1, wherein the antenna is capable of transmitting electromagnetic signals and receiving electromagnetic signals.

10. The antenna of claim 1, wherein the antenna is fed at a single port of the radiating element.

11. The antenna of claim 8, wherein the first planar circular structure and the second planar circular structure are fed as elements of a phased array with an adjustable phase difference between the elements enabling control of an elevation angle of a main radiation beam.

12. A method comprising:

selectively connecting, at an antenna, a particular parasitic element of one or more parasitic elements of the antenna to a reactive load and to ground using a first switch of one or more switches, wherein each switch of the one or more switches separates a corresponding parasitic element of the one or more parasitic elements from ground, wherein the one or more parasitic elements are located on a contour around a radiating element of the antenna, wherein the radiating element is located at a center of a planar circular structure of the antenna, wherein the one or more parasitic elements are aligned in a parallel direction with the radiating element, wherein the one or more parasitic elements protrude from the planar circular structure, and wherein the particular parasitic element acts as a reflector with a phase difference when the particular parasitic element, ground, and the reactive load are connected.

13. The method of claim 12, further comprising:

selectively connecting the particular parasitic element to ground and selectively disconnecting the particular parasitic element from the reactive load using the first switch, wherein the particular parasitic element acts as a reflector without a phase difference when the particular parasitic element is connect to ground and the particular parasitic element is disconnected from the reactive load.

14. The method of claim 12, further comprising:

selectively disconnecting the particular parasitic element from ground and disconnecting the particular parasitic element from the reactive load using the first switch, wherein the particular parasitic element acts as a director when the particular parasitic element is disconnected from ground and the particular parasitic element is disconnected from the reactive load.

15. A non-transitory computer-readable medium encoded with computer-executable instructions that, when executed by a processor, cause the processor to:

selectively disconnect, at an antenna, a particular parasitic element of one or more first parasitic elements of the antenna from ground using a particular switch of one or more first switches of the antenna, wherein each first switch of the one or more first switches separates a corresponding parasitic element of the one or more first parasitic elements from ground, wherein the one or more first parasitic elements are located on a contour around a radiating element of the antenna, wherein the radiating element is located at a center of a first planar circular structure of the antenna, wherein the one or more first parasitic elements are aligned in a parallel direction with the radiating element, wherein the one or more first parasitic elements protrude from the first planar circular structure, wherein a second planar circular structure is stacked perpendicular to the first planar circular structure, wherein a same number of one or more second parasitic elements protrude from the second planar circular structure as a number of the one or more first parasitic elements that protrude from the first planar circular structure, and wherein each second switch of one or more second switches corresponds to a particular first switch of the one or more first switches, separates a corresponding second parasitic element of the one or more second parasitic elements from ground, and has a same configuration as the particular first switch.

16. The non-transitory computer-readable medium of claim 15, wherein the first circular planar structure and the second circular planar structure are fed as elements of a phased array with an adjustable phase difference between the elements enabling control of an elevation angle of a main radiation beam.

17. The non-transitory computer-readable medium of claim 15, further comprising:

selectively connecting the particular parasitic element to ground and selectively disconnecting the particular parasitic element from a reactive load using the particular switch, wherein the particular parasitic element acts as a reflector without a phase difference when the particular parasitic element is connected to ground and the particular parasitic element is disconnected from the reactive load.

18. The non-transitory computer-readable medium of claim 15, further comprising:

disconnecting the particular parasitic element from a reactive load using the particular switch, wherein the particular parasitic element acts as a director when the particular parasitic element is disconnected from ground and the particular parasitic element is disconnected from the reactive load.

19. The non-transitory computer-readable medium of claim 15, further comprising:

selectively connecting the particular parasitic element to ground and connecting the particular parasitic element to a reactive load using the particular switch, wherein the particular parasitic element acts as a reflector with a phase difference when the particular parasitic element, ground, and the reactive load are connected.

20. An apparatus comprising:

means for selectively disconnecting, at an antenna, a particular parasitic element of one or more first parasitic elements of the antenna from ground using a particular switch of one or more first switches of the antenna, wherein each first switch of the one or more first switches separates a corresponding parasitic element of the one or more first parasitic elements from ground, wherein the one or more first parasitic elements are located on a contour around a radiating element of the antenna, wherein the radiating element is located at a center of a first planar circular structure of the antenna, wherein the one or more first parasitic elements are aligned in a parallel direction with the radiating element, wherein the one or more first parasitic elements protrude from the first planar circular structure, wherein a second planar circular structure is stacked perpendicular to the first planar circular structure, wherein a same number of one or more second parasitic elements protrude from the second planar circular structure as a number of the one or more first parasitic elements that protrude from the first planar circular structure, and wherein each second switch of one or more second switches corresponds to a particular first switch of the one or more first switches, separates a corresponding second parasitic element of the one or more second parasitic elements from ground, and has a same configuration as the particular first switch.

21. The apparatus of claim 20, wherein the first circular planar structure and the second circular planar structure are fed as elements of a phased array with an adjustable phase difference between the elements enabling control of an elevation angle of a main radiation beam.

22. The apparatus of claim 20, further comprising:

selectively connecting the particular parasitic element to ground and selectively disconnecting the particular parasitic element from a reactive load using the particular switch, wherein the particular parasitic element acts as a reflector without a phase difference when the particular parasitic element is connected to ground and the particular parasitic element is disconnected from the reactive load.

23. The apparatus of claim 20, further comprising:

selectively disconnecting the particular parasitic element from a reactive load using the particular switch, wherein the particular parasitic element acts as a director when the particular parasitic element is disconnected from ground and the particular parasitic element is disconnected from the reactive load.

24. The apparatus of claim 20, further comprising:

selectively connecting the particular parasitic element to ground and selectively connecting the particular parasitic element to a reactive load using the particular switch, wherein the particular parasitic element acts as a reflector with a phase difference when the particular parasitic element, ground, and the reactive load are connected.

* * * * *